US011994123B2

(12) United States Patent
Pozzo et al.

(10) Patent No.: US 11,994,123 B2
(45) Date of Patent: May 28, 2024

(54) VARIABLE DISPLACEMENT HYDRAULIC PUMP

(71) Applicant: PMP PRO-MEC S.P.A., Coseano (IT)

(72) Inventors: Riccardo Pozzo, Coseano (IT); Luca De Carli, Coseano (IT)

( * ) Notice: Subject to any disclaimer, the term of this patent is extended or adjusted under 35 U.S.C. 154(b) by 0 days.

(21) Appl. No.: 17/905,974

(22) PCT Filed: Feb. 24, 2021

(86) PCT No.: PCT/EP2021/000020
§ 371 (c)(1),
(2) Date: Sep. 9, 2022

(87) PCT Pub. No.: WO2021/180357
PCT Pub. Date: Sep. 16, 2021

(65) Prior Publication Data

US 2023/0151806 A1 May 18, 2023

(30) Foreign Application Priority Data

Mar. 9, 2020 (IT) ..... 102020000005020

(51) Int. Cl.

| | |
|---|---|
| ***F04B 49/00*** | (2006.01) |
| ***F04B 1/295*** | (2020.01) |
| ***F04B 1/324*** | (2020.01) |
| ***F04B 49/06*** | (2006.01) |
| ***F04B 53/10*** | (2006.01) |

(52) U.S. Cl.
CPC ..... *F04B 49/002* (2013.01); *F04B 1/295* (2013.01); *F04B 1/324* (2013.01); *F04B 49/065* (2013.01); *F04B 53/1082* (2013.01); *F04B 2201/12041* (2013.01); *F04B 2201/12051* (2013.01)

(58) Field of Classification Search
CPC ..... F04B 1/295; F04B 1/324; F04B 49/002; F04B 49/065; F04B 53/1082; F04B 2201/12041; F04B 2201/12051
USPC ..... 91/505, 506
See application file for complete search history.

(56) References Cited

U.S. PATENT DOCUMENTS 4,456,434 A * 6/1984 El Ibiary ..... F04B 49/002 60/389
4,487,109 A * 12/1984 Burandt ..... F04B 1/324 417/222.2
4,756,157 A * 7/1988 Appel ..... F16H 61/433 60/452
5,205,201 A 4/1993 Goellner
(Continued)

FOREIGN PATENT DOCUMENTS

EP 0087773 A1 9/1983
JP H08177745 A 7/1996

OTHER PUBLICATIONS

International Search Report for corresponding PCT/EP2021/000020 dated Mar. 26, 2021.

(Continued)

*Primary Examiner* — Michael Leslie
(74) *Attorney, Agent, or Firm* — Egbert, McDaniel & Swartz, PLLC

(57) ABSTRACT

Control system and control method of a variable displacement hydraulic pump wherein the system includes a detection sensor for detection of the actually set displacement and a control unit for current control of a couple of solenoids controlling displacement increase and decrease.

25 Claims, 14 Drawing Sheets

(56) References Cited

U.S. PATENT DOCUMENTS

| | | | | |
|---|---|---|---|---|
| 5,226,349 | A * | 7/1993 | Alme | F04B 1/324 91/506 |
| 5,758,499 | A | 6/1998 | Sugiyama et al. | |
| 5,865,602 | A * | 2/1999 | Nozari | F04B 49/06 60/449 |
| 7,121,188 | B2 * | 10/2006 | Thoms | F01B 3/102 91/506 |
| 7,171,887 | B2 * | 2/2007 | Lilla | F04B 1/324 60/426 |
| 7,975,599 | B2 | 7/2011 | Geissler et al. | |
| 9,932,957 | B2 * | 4/2018 | Thoms | F03C 1/005 |
| 10,801,492 | B2 * | 10/2020 | Bahna | F04B 1/2078 |
| 11,608,825 | B2 * | 3/2023 | Kharpas | F04B 1/122 |
| 2014/0311139 | A1 | 10/2014 | Lasaar et al. | |

OTHER PUBLICATIONS

Written Opinion of the International Searching Authority for corresponding PCT/EP2021/000020 dated Mar. 26, 2021.
International Preliminary Report on Patentability for corresponding PCT/EP2021/000020 dated Sep. 30, 2021.

* cited by examiner

VARIABLE DISPLACEMENT HYDRAULIC PUMP

TECHNICAL FIELD

The present invention relates to a variable displacement hydraulic pump according to the characteristics of the pre-characterizing part of claim 1.

PRIOR ART

In the field of variable displacement hydraulic pumps the use of control systems is known which allow the variation of the displacement of the variable displacement pump and which also allow a reversal of the direction of rotation of the actuation system controlled by the pump itself.

The solutions of prior art provide that the pump is controlled by means of an electrohydraulic control group usually called "RE", acronym for "Remote electric". The control group RE of known type consists of a set of three solenoids which actuate three respective slide valves. This type of command allows the manufacturer of the vehicle on which the pump is installed, such as a concrete mixer, to directly connect the pump to a remote control push-button panel which allows the operator to control and command the pump, and therefore the machine, to perform the functions for which it is intended.

The application D1 JP H08 177745 describes a solution for improving accuracy and reliability in a control device of the flow rate of a hydraulic pump. There is a mechanical flow rate detection mechanism which is arranged in a delivery pipe of a hydraulic pump. There is also a feedback spring which is arranged between an outlet element and a coil of a proportional four-way solenoid valve. A delivery flow rate of the hydraulic pump is mechanically retransmitted to the proportional solenoid valve. A control current corresponding to a desired value of the pump delivery flow rate is sent in output to a solenoid of the proportional solenoid valve by a control unit.

The application D2 U.S. Pat. No. 7,975,599 describes an adjustment device for a hydrostatic piston engine. The adjustment device comprises an electronic control unit for the generation of adjustment signals. An adjustment position of the hydrostatic piston motor scanned by a feedback element is detected by a sensor of the contactless electronic control unit.

The application D3 EP 0 087 773 describes a control system for a variable displacement pump comprising a variable displacement pump having a movable element for controlling the displacement of the pump, a hydraulic motor for moving the movable element and a transducer for producing an electrical signal corresponding to the actual position of the movable element. A comparator compares the electrical signal from the transducer and an electrical signal corresponding to the desired displacement of the pump and produces an error signal. A control unit operates in response to the error signal to measure the flow of fluid from the pump outlet towards the hydraulic motor. The control unit includes a release valve, a compensating valve and a servo valve. The servo valve is preferably a single-stage valve which includes damping orifices to provide stability.

The application D4 U.S. Pat. No. 5,758,499 describes a hydraulic control system suitable for hydraulically solving a problem caused when a control unit is used to control the displacement of a hydraulic pump based on a status variable of a hydraulic drive system. To this end, a pump regulator is made in such a way as to increase the angle of inclination of a swash plate with a pressure reduction of a second hydraulic signal. A pump regulator characteristic is set so that a negative control pressure can be used to drive the pump regulator instead of the second hydraulic signal. Furthermore, the characteristics of a fixed throttle valve and of a spring in the pump regulator are set so that the pump regulator can be operated in the operating range of the negative control pressure. The control unit sets a modified negative control pressure as the target value of the second hydraulic signal and determines a second electrical signal corresponding to the target value in a suitable block, so that the operating range of the second hydraulic signal generated by the proportional solenoid valve is substantially at the same level as the operating range of the negative control pressure.

The application D5 U.S. Pat. No. 5,205,201 describes a displacement control valve having a valve body with a fluid measurement valve bobbin which is axially movable between the pilot pressure chambers formed at opposite ends of an internal hole of the valve body. An internal spring feedback apparatus is mounted on the valve bobbin in one of the pilot pressure chambers and elastically connects the swash plate of a variable displacement hydraulic unit with the valve bobbin. An elongated housing surrounds the spring and the spring guides and it is mechanically coupled to the swash plate. The housing and the spring guides form a fluid seal between the valve bobbin and the valve body to seal the pilot pressure chamber in which the feedback apparatus is mounted.

The application D6 US 2014/311139 describes a variable flow rate hydrostatic pump which has a displacement set by an electro-hydraulic control device equipped with a safety function. In the event of a failure, the variable flow rate pump is set on a neutral position. The electro-hydraulic control device has a single electro-hydraulic setpoint encoder to specify the setpoint of the movement volume of the variable displacement pump and a valve which can be electrically operated connected in series downstream of the setpoint encoder, through which the direction of movement is controlled of the variable displacement pump.

Problems of Prior Art

The RE control group of known type, consisting of a set of three solenoids has considerable disadvantages.

In the known systems there is a considerable dependence of the RE control group on oil temperature, which in turn also depends on ambient temperature. This makes the commands of known systems non-repetitive and further involves problems relative to the zeroing phase of the pump, a phase for which the presence of additional components is required which guarantee the restoration of the neutral conditions in which the pump is in a stop condition.

The hydraulic construction is complicated and, consequently, the use of a large number of components is required with problems relative to both the high cost of the pump and its reliability.

Furthermore, the prior art systems are not retro-operable and the operator progressively increases and decreases the displacement without really knowing what the real set displacement is, since it is obtained by means of impulse commands which act on the actuation solenoids whose behaviour in relation to the valve is not repetitive.

Aim of the Invention

Aim of the present invention is to supply a variable displacement hydraulic pump with improved control system.

Concept of the Invention

The aim is achieved with the characteristics of the main claim. The sub-claims represent advantageous solutions.

Advantageous Effects of the Invention

The solution according to the present invention, through the considerable creative contribution the effect of which constitutes an immediate and not negligible technical progress, has various advantages.

The variable displacement hydraulic pump with improved control system according to the present invention is advantageously independent of oil temperature and ambient temperature.

Furthermore, the system is more responsive to the commands given which are more precise and reliable.

The variable displacement hydraulic pump with improved control system further allows programmable customization operations which allow, for example, the operator to select operating modes in which the commands given are more reactive or less reactive, in which the steps of displacement increase or displacement decrease have greater effects obtaining higher speed or lower effects obtaining greater precision.

Advantageously, the stop and displacement variation commands can be made independent of each other.

A great advantage is that the inventive system also allows to perform diagnostic operations with visualization of the system status and reporting of possible failures or anomalies present to the operator in real time.

Furthermore, the system also allows monitoring with storage of oil temperature in a continuous way.

The system is retro-activated and, therefore, the displacement actually set on the pump is known at all times.

Simplification with respect to known systems with reduction in the number of components and in cost and an increase in reliability.

Great simplification of mechanical processing with reduction in the cost of the pump.

DESCRIPTION OF THE DRAWINGS

An embodiment solution is hereinafter described with reference to the enclosed drawings to be considered as a non-limitative example of the present invention in which.

DESCRIPTION OF THE INVENTION

The present invention relates to a variable displacement hydraulic pump with improved control system.

Figure 1:
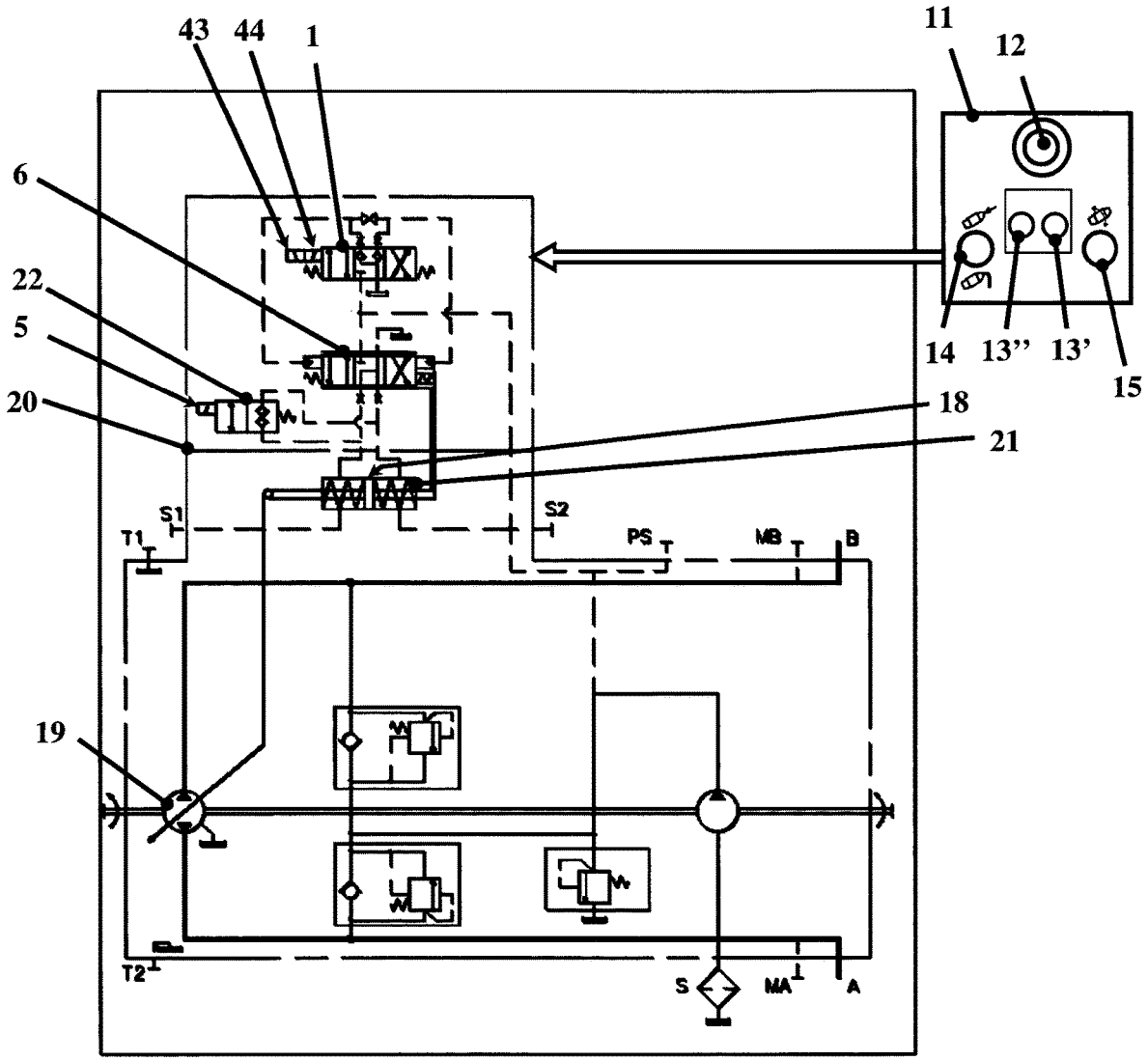
Prior art Fig. 1
FIG. 1 represents a scheme of the components of a variable displacement hydraulic pump and relative control of the prior art.
Figure 2:
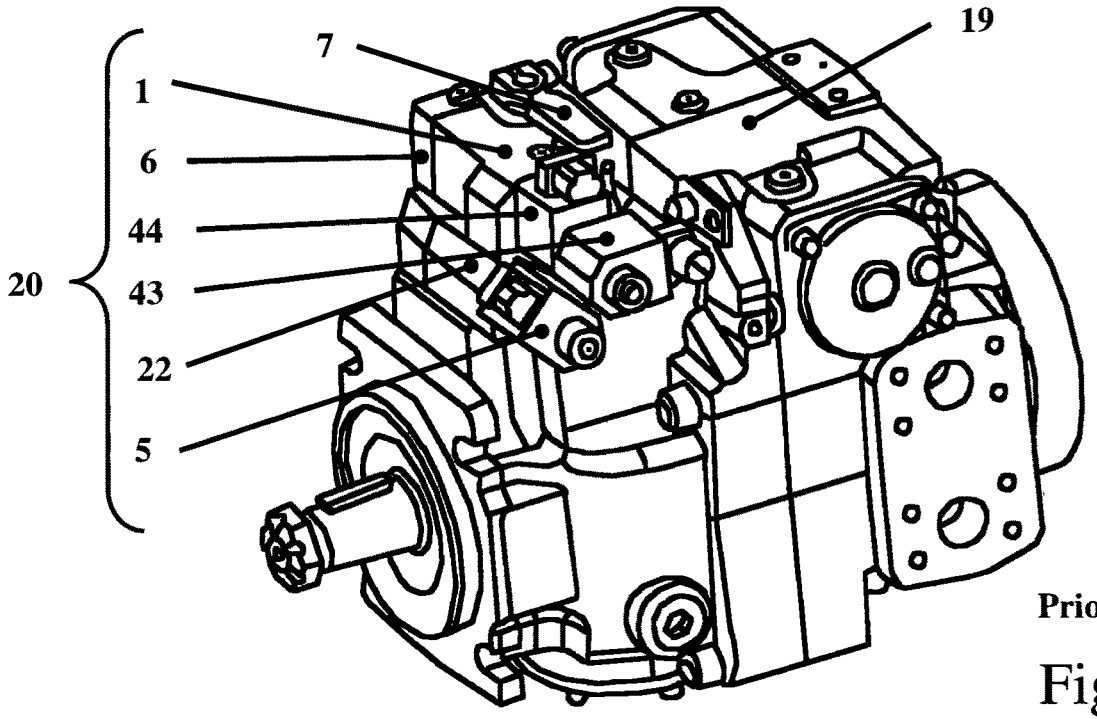
Prior art Fig. 2
FIG. 2 represents a variable displacement hydraulic pump and relative control of the prior art.
Figure 3:
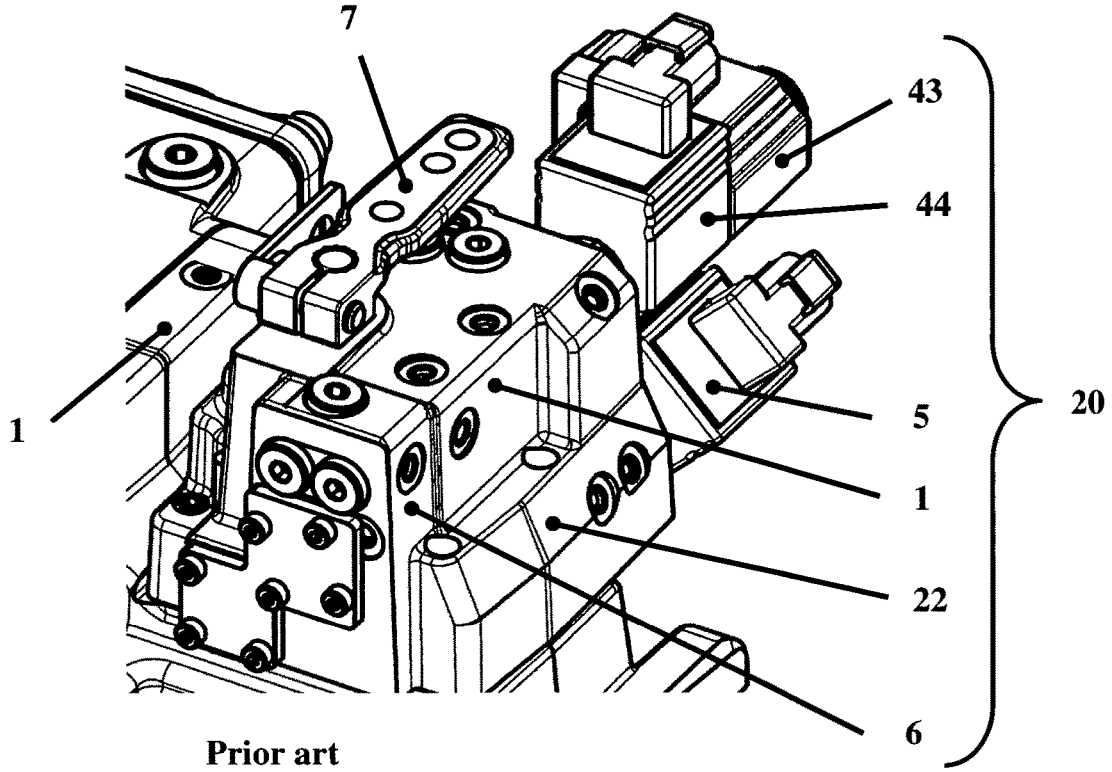
Prior art Fig. 3
FIG. 3 represents a detail of the variable displacement hydraulic pump of FIG. 2.
Figure 4:
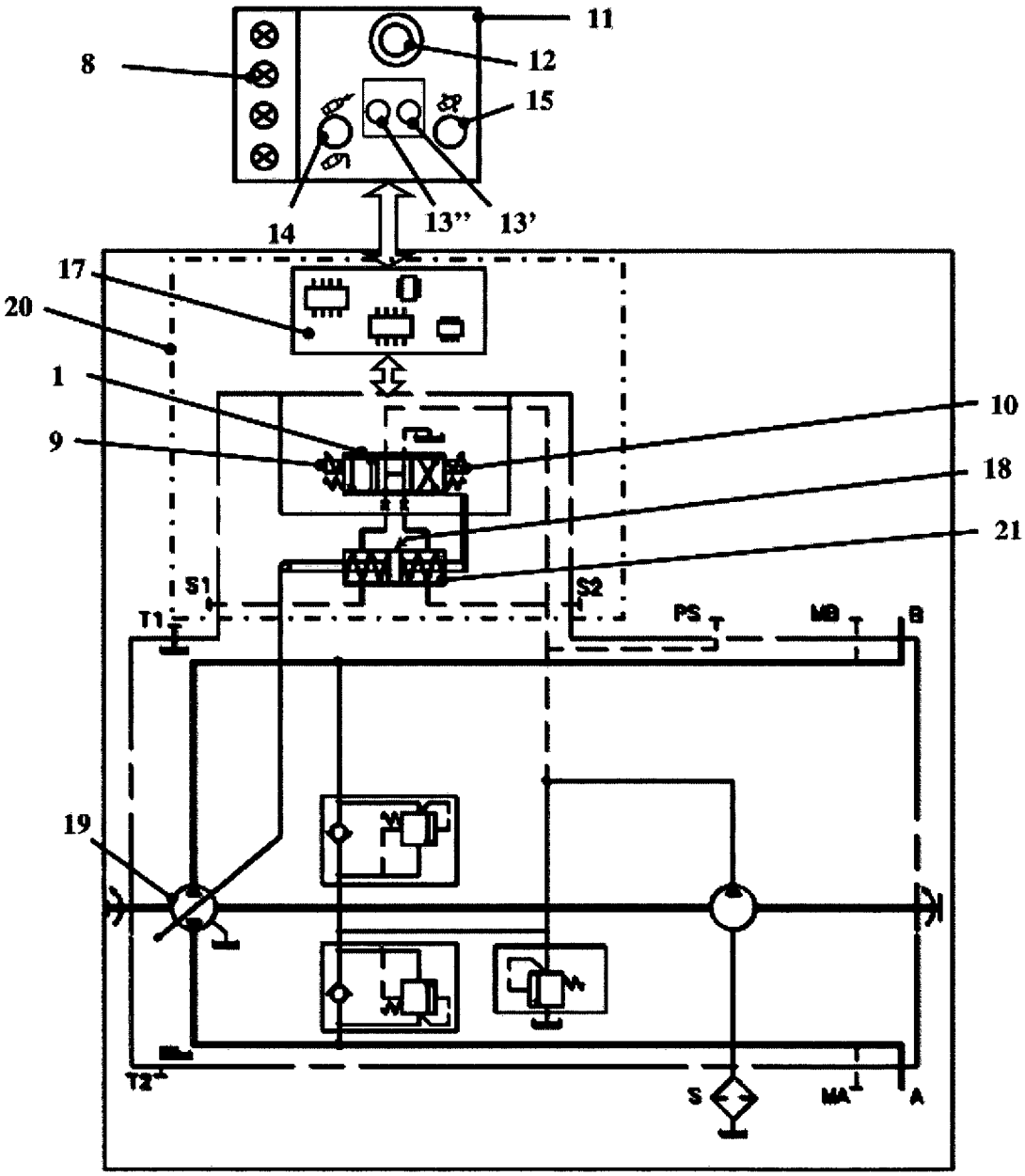
FIG. 4 represents a scheme of the components of the inventive variable displacement hydraulic pump and relative control.
Figure 5:
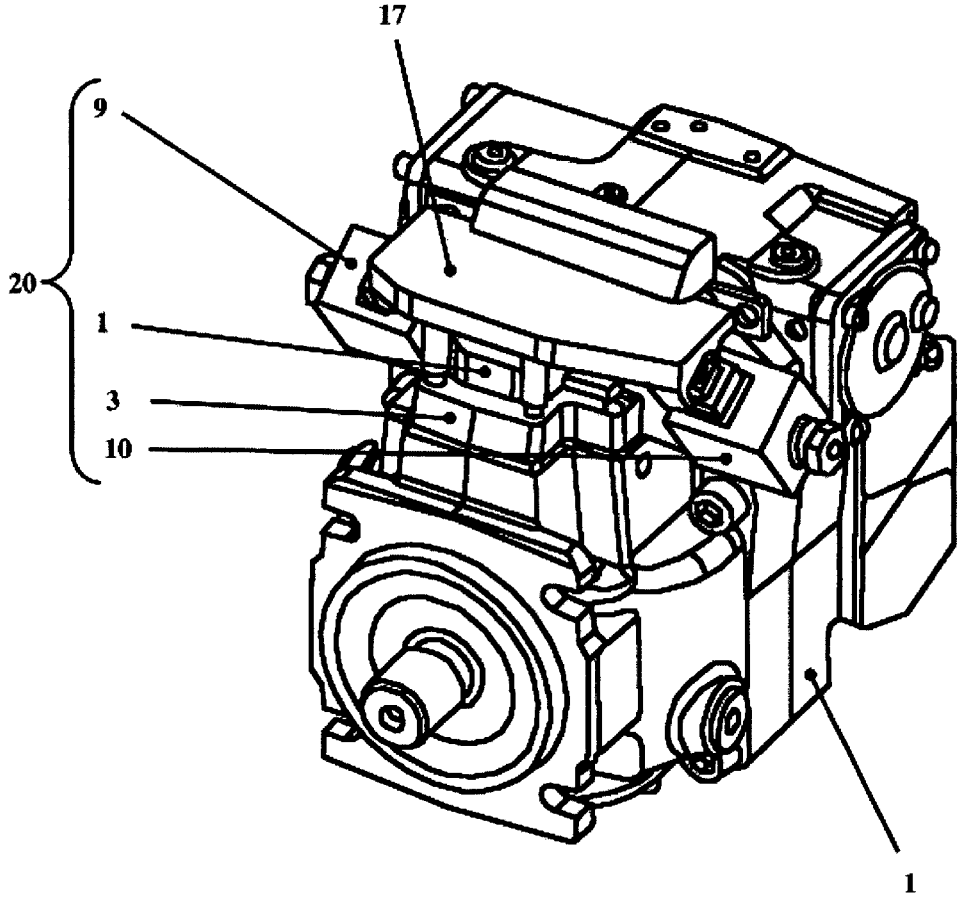
FIG. 5 represents an inventive variable displacement hydraulic pump and relative control.
Figure 6:
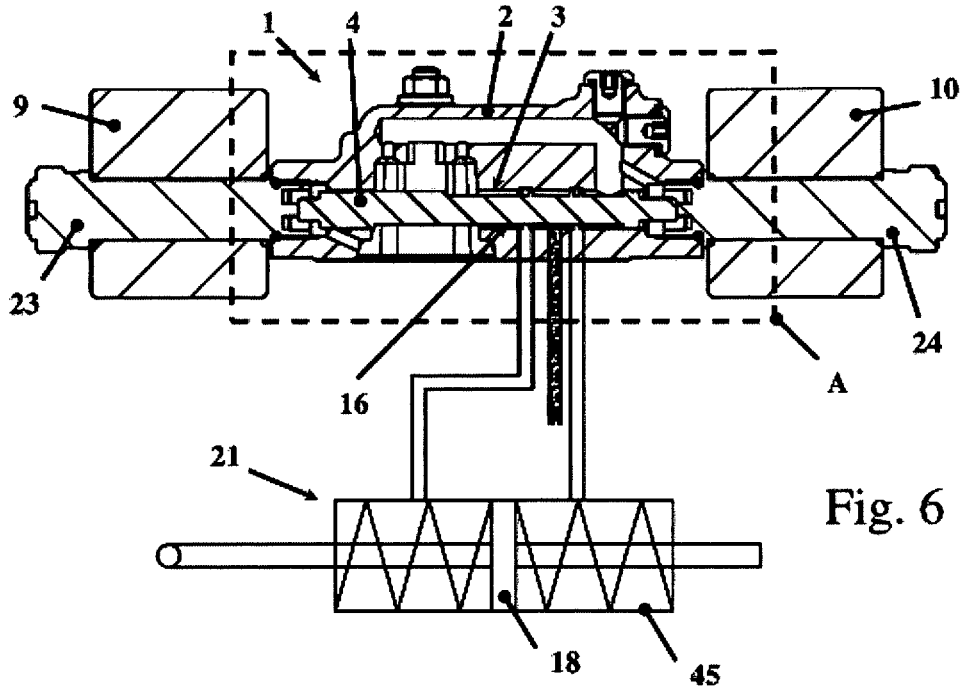
FIG. 6 represents a part of the control system of the inventive variable displacement hydraulic pump and relative control in a rest condition.

With reference to the solutions of prior art (FIG. 1, FIG. 2, FIG. 3) the control systems in use allow the variation of the displacement of the variable displacement pump and also a reversal of the direction of rotation of the actuation system controlled by the pump itself. The known solutions provide that the pump is controlled by means of a control system (20) of prior art consisting of a set of valves comprising:

a driving valve (1);

a control valve (6);

a bypass valve (22).

The control system (20) of prior art (FIG. 1, FIG. 2, FIG. 3) further comprises a series of valve driving solenoids among which:

a displacement increase solenoid (43) and a displacement decrease solenoid (44) which are applied to the driving valve (1);

a stop solenoid (5) which is applied to the bypass valve (22).

Therefore, in prior art solutions, the control system (20) consists of a set of three solenoids (5, 43, 44) which actuate two slide valves. Two solenoids (43, 44) act on a spool of a valve, and an additional stop solenoid (5) acts on another different valve which is the bypass valve.

As explained above, this type of control system (20) allows the manufacturer of the vehicle on which the pump is installed, such as a concrete mixer, to directly connect (FIG. 1) the pump to a remote control device (11) for example in the form of a push-button panel which allows the operator to control and command the pump, and therefore the machine, to perform the functions it is intended for. The remote control device (11) can be shaped in many ways according to the customer's needs. For example, in the non-limitative case of application on a truck mixer, the remote control device (11) can comprise a displacement increase button (13') and a displacement decrease button (13") for adjusting the displacement of the pump which allow the displacement to be increased or decreased by means of a command impulse in one direction or in the opposite direction. In prior art solutions, depending on how much either button is pressed between the displacement increase button (13') and the displacement decrease button (13"), the pump displacement increases or decreases until the respective button is released and then it remains at the set value. The pump is always symmetrical, that is there is a maximum positive displacement (such as 90 cc) and a maximum negative displacement (such as −90 cc). By acting on the buttons it is possible to progressively pass from a positive displacement to a negative displacement, passing through the zero condition. Zero corresponds to the stop condition of the pump, which, in the exemplary and non-limitative case of application for a concrete mixer, corresponds to a stop condition of the drum of the concrete mixer. The maximum displacement (such as 90 cc) corresponds to the maximum speed in one direction, the minimum displacement (such as −90 cc) corresponds to the maximum speed in the opposite direction. In order to zero the displacement, the operator manually reaches zero by acting on the buttons, judging by sight when the drum stops. Furthermore, there is an emergency button (12) which, as it will be explained, also acts as an emergency displacement zeroing button to stop the pump.

The control system (20) of RE type is made (FIG. 2, FIG. 3) as a control block which is mounted directly on the variable displacement pump (19). As explained, in the known system there is a considerable dependence of the control system (20) of RE type on oil temperature, which in turn also depends on ambient temperature. This makes the commands of known systems non-repetitive and further involves problems relative to the zeroing phase of the pump, which is a phase for which the presence of additional components is required which guarantee the restoration of the neutral conditions in which the pump is in a stop condition.

Indeed, the control system (20) of RE type of prior art consists of the three solenoids of which two solenoids, that is the displacement increase solenoid (43) and the displacement decrease solenoid (44), are applied on the same driving valve (1) of cartridge type.

The two solenoids, that is the displacement increase solenoid (43) and the displacement decrease solenoid (44), which act on the driving valve (1) are installed so as to provide two contrasting magnetic fields: one solenoid moves the valve on one side, opening a conduit, while the other solenoid moves the valve in the opposite direction, opening another conduit. The valve returns to central and neutral position, keeping both conduits closed. By opening either conduit, the driving valve (1) causes the oil to flow towards the two sides of the control valve (6), causing it to move. This movement, in turn, leads to the movement of a piston (18) which acts directly on the displacement change cylinder (45), a component usually referred to as a servo-control piston. The reactivity of the command, that is the time to pass from maximum displacement to zero, or to pass from the maximum displacement with clockwise rotation to the maximum displacement with anti-clockwise rotation, depends on the size of some throttles, located along the paths followed by the oil when it moves from the driving valve (1) to the control valve (6). The same happens when the rotation stop or emergency command is given. As a result, the system is constrained to these components, and it is not possible to achieve the flexibility sought by some customers. In particular, it will not be possible to have distinct acceleration and deceleration slopes, as the oil will have to pass through the same path in two different directions, crossing the same throttle in both directions.

The control system (20) of RE type of prior art also includes a stop solenoid (5) which acts on an electric bypass valve (22) which causes the stop in normal conditions or in emergency. The stop solenoid (5) acts on the bypass valve (22) which is an ON/OFF type valve, which opens circulating oil through a bypass path. This causes the zeroing of the displacement and the consequent zeroing of the main oil flow rate. The stop solenoid (5) is activated by means of a special button, emergency button (12) on the remote control device (11). The operator has the possibility to zero the displacement by pressing this key. When this key is released, the displacement will automatically return to the previous value, since pressing the emergency button (12) does not cause the proportional control valve (6) to move, which maintains a memory effect. This happens because the stop and emergency system constitutes a bypass system in all respects and it does not intervene in any way on the system components upstream of it, which all maintain the same configuration previously set by the operator.

The control system (20) of RE type of prior art also comprises a handle grip (7), such as for example a lever, manually operated for the emergency operation of the pump, which acts mechanically on the control valve (6).

Due to the fact that there is a dependence on the temperature and the commands given to the displacement increase and decrease impulses have, in the light of this dependence on the temperature, a different effect on the system, as a consequence there is an inability to zero the pump by means of the two solenoids, that is the displacement increase solenoid (43) and the displacement decrease solenoid (44), which act on the driving valve (1). Indeed, by giving a series of displacement increase commands and subsequently the same number of displacement decrease commands, the system does not return to the initial zero position.

This also depends on the fact that the control system (20) of RE type of prior art is not retro-operable and the operator progressively increases and decreases the displacement without really knowing what the actual set displacement is, since it is obtained by means of impulse commands which act on the actuation solenoids (43, 44) whose behaviour in relation to the valve is not repetitive. Therefore, the lack of retroaction involves a lack of control of the real conditions of the system and it is not possible to know the actual displacement actually set by the operator.

The inventive variable displacement pump (19) (FIG. 4, FIG. 5, FIG. 6, FIG. 8, FIG. 10) comprises an innovative control system which comprises a control unit (17) which is advantageously made in the form of an electronic card directly integrated on the body of the variable displacement pump (19).

The electronic card converts the digital inputs of control coming from a control push-button panel (11) into a current modulated signal which powers two solenoids consisting of a first solenoid (9) and a second solenoid (10) of a proportional electric control.

Advantageously, the first solenoid (9) and the second solenoid (10) of proportional type generate a thrust proportional to the current which is delivered and in this way it is possible to control more precisely the real position of the valve components and, therefore, the set displacement. Indeed, the control unit not only generates the control current of the first solenoid (9) and of the second solenoid (10), but also acquires the control current signal actually present in transmission towards each one of the two solenoids (9, 10), it verifies the correspondence of the set current value with a relative set-point and, on the basis of this feedback signal, it corrects the value actually measured to make it correspond to the set-point.

Indeed, since these are two proportional solenoids, the current feedback of the system allows accurate regulation of the amount of current, making the final behaviour of the hydraulics independent of the temperature. The problem, in this regard, is due to the thermal drift of the performance of the solenoid as temperature changes. As temperature increases, indeed, the resistance of the solenoid increases. In prior art systems, by not providing current feedback, the power on the displacement increase and decrease solenoids (43, 44) is kept constant and not the current. During operation, therefore, as each one of the two displacement increase and decrease solenoids (43, 44) heats up, its resistance increases, and consequently the current absorbed is reduced as the resistive effect prevails over the inductive effect. The result of this effect is a reduction in the pump displacement. By keeping the current constant, instead, the system regulates itself, compensating for the thermal drift effects of first solenoid (9) and second solenoid (10). As the temperature increases, the inventive system will react by increasing the power injected into the first solenoid (9) or into the second solenoid (10), and consequently it will compensate for the increasing losses due to the Joule effect. The control unit (17) in the form of an electronic card, by means of the same system, is able to manage the aging of the components.

The control unit (17), in the form of an electronic card, is at least equipped with the following inputs:

- displacement increase command;
- displacement decrease command;
- stop command;
- speed of the hydraulic motor connected to the pump, by means of a detection sensor;
- pump temperature, measured by a temperature sensor mounted on the card and in direct contact with the pump;
- CAN communication port for connection to PC or other electronic peripherals.

The control unit (17), in the form of an electronic card, is at least equipped with the following outputs:

- current output for command of the first solenoid (9);
- current output for command of the second solenoid (10).

The control logic of the current outputs is of the PID type for controlling the current delivered to each one between first solenoid (9) and second solenoid (10), according to what the present description hereinafter describes.

First and second solenoid (9, 10) act directly on two valves (23, 24). The first solenoid (9) acts on a first valve (23) and the second solenoid (10) acts on a second valve (24) which directly push a main spool (4), to opposite directions.

Each one of the valves (23, 24) comprises an internal valve piston which is moved by the magnetic force generated by the respective solenoid (9, 10). Each one of the valves (23, 24) in turn comprises a stem connected to the internal piston of the valve in which the stem acts on the spool (4). The proportionality of the command given by means of the control unit (17) is obtained thanks to the use of current control since a determined force applied to the stem of the respective valve (23, 24) corresponds to a determined current applied to the respective solenoid (9, 10) and this force is transferred from the stem to the spool (4), under the balancing action of the spring (37), which, being linear, will cause the conduits to open according to a law proportional to the force and, therefore, to the current applied which is the control current of the solenoids (9, 10) applied by the control unit (17).

The body (2) also comprises discharge conduits comprising a first discharge conduit (33), a second discharge conduit (34), a third discharge conduit (30), a fourth discharge conduit (31), a fifth discharge conduit (32). Third discharge conduit (30), fourth discharge conduit (31), and fifth discharge conduit (32) drain the return fluid from the cylinder of the displacement variation control device (21) when the piston (18) moves (FIG. 10) in the direction towards the right. The same function is also performed by the interstice (16), when (FIG. 8) the piston (18) moves to the left. The first discharge conduit (33) and the second discharge conduit (34) drain the head of the spool (4) on the opposite side with respect to the thrust solenoid to avoid the syringe effect, that is the fact that the chamber in correspondence with that head creates a suction effect on the spool (4) counteracting the force of the opposite solenoid.

Advantageously, by means of the described system, the function is obtained according to which the driving valve (1) maintains the set displatement until the relative solenoid selected between first solenoid (9) and second solenoid (10) is kept energized, keeping the current constant on it by means of the retro-operated control.

Compared to the control system (20) of prior art (FIG. 1, FIG. 2, FIG. 3), both the bypass valve (22) and the control valve (6) are absent in the inventive control system (20) since only the driving valve (1) is maintained with relative main spool (4) which is able to perform all the same functions also thanks to the control unit (17) and configuration described with first solenoid (9) and relative first valve (23) and second solenoid (10) and relative second valve (24).

Advantageously and contrary to the solutions of prior art, in the inventive solution the hydraulic command given is not able to support itself and requires the driving current to function. In this way, by removing the current, the system returns to the neutral position, also obtaining the advantage of being able to reduce the number of components, at the same time increasing the safety and reliability of the system, also avoiding the problem of prior art solutions in which acting on the bypass an interruption is obtained but without a zeroing of the system which remains on the displacement set prior to the activation of the bypass.

Thanks to the control unit (17) and to the configuration of the driving valve (1) of the inventive system it is therefore possible to replicate all the functions of the control system (20) of prior art but with improved functionality and with additional functions such as the setting of programmable customizations which allow, for example, the operator to select operating modes in which the commands given are more reactive or less reactive, in which the steps of displacement increase or displacement decrease have greater effects obtaining greater speed or minor effects obtaining greater accuracy. Each parameter can be configured. Consequently, it is possible to modify at will, without any reciprocal dependence, the slope of the acceleration, deceleration and stop lines. This peculiarity allows to overcome the limitations present in prior art systems, where the slopes were constrained to each other. The behaviour of the system can be completely customized. These functions are obtained by appropriately programming the control unit (17) in the form of an electronic card placed on the pump. With the same input signal on the displacement increase input, for example, different current slopes can be obtained on the output solenoid selected between first solenoid (9) and second solenoid (10), which cannot be achieved with prior art systems.

It is possible to connect to the control unit (17), in the form of an electronic card, through a wireless communication channel, such as for example from an application on a smartphone or an application on a PC. Once connected to the control unit (17) through the wireless communication channel, it is possible to:

- send configuration parameters;
- access the diagnostic data stored in the memory;
- update the firmware of the control unit (17), in the form of an electronic card.

It will also be possible to integrate a radio module into the control unit for connection via the 4G/LTE network. Through this connection it will be possible to access the machine parameters remotely. It will be therefore possible to manage the same parameters which can be managed through the wireless communication channel but without being in the proximity of the machine.

Furthermore, the stop and displacement variation commands can be made independent of each other. These functions are obtained by appropriately programming the control unit (17) located on the pump. For example, in the case of application on a truck mixer, the drum rotation stop command can correspond to a specific slope of the current of a solenoid (9, 10) towards zero. The command to increase or decrease the displacement can correspond to another independent slope, which corresponds to a different reactivity.

A great advantage is that the inventive system also allows to perform diagnostic operations with visualization of the system status and reporting of any failures or anomalies present in real time to the operator. The control unit (6), indeed, is able to understand whether:

- there is a short circuit on the push-button panel;
- there is a short circuit on one of the two solenoids selected between first solenoid (9) and second solenoid (10) or both by detecting an excess current in the current feedback measurement;
- there is an open side on one of the two solenoids selected between first solenoid (9) and second solenoid (10) or both by detecting a null current in the current feedback measurement;
- there is a damage in the solenoid selected between first solenoid (9) and second solenoid (10) with consequent shorting.

These functions are obtained by appropriately programming the control unit (17) placed on the pump based on the data the control unit (17) reads: operating temperatures, current set values, current real value.

Furthermore, it is also possible to also integrate in the remote control device (11) status indicators (8), such as for example light indicators or also a diagnostic display, on which the alarms of detected failures, the actually set displacement, etc. can be viewed.

Furthermore, the control unit (6) is able to verify the operating temperatures of the machine and bring it to safe conditions. Indeed, the system also allows monitoring with storage of the oil temperature in a continuous way, which can be used to provide indications on the status indicators in the form of light indicators or diagnostic display.

The control unit (17) in the form of an electronic card is advantageously equipped with a temperature sensor inserted directly on the card and in contact with the surface of the pump. The control unit (17) can be programmed in such a way that if the temperature reaches determined values and for a determined time, appropriate actions are carried out, such as, for example, but not limited to, the lighting of suitable lights on the control unit (17) itself and/or of status indicators (8) on the remote control device (11) or the decrease of the pump displacement in order to reduce the power dissipated in the hydraulic circuit. All this is achieved through software programming of the card constituting the control unit (17).

The control unit (17) can also receive the input signal coming from a speed sensor placed on the hydraulic motor connected to the pump (19). With reference to the concrete mixer application, the control unit (17) can be programmed to create a closed loop control cycle which keeps the drum rotation speed constant at the value set through the push-button panel (11), independently of the rotation speed of the diesel engine or hydraulic pump. This allows, in the example of the truck mixer application, to keep the mixing speed constant during the transport journey of the concrete, with a great advantage in the quality of the mixed product. In this case the control unit will be equipped with a speed signal input to be used as a second feedback signal for controlling the displacement variation of the pump (19) in order to control the speed of the hydraulic motor connected to the pump. It will be therefore possible to implement a control phase of the current of the solenoids in such a way as to regulate not according to the position feedback of the piston (18) of the servo-control device but according to the speed of the hydraulic motor which, in turn, depends on the position of the spool (3).

The first valve (23) and the second valve (24) are obtained within a body (2). In the body there is a seat (3) for sliding of a main spool (4) whose function will be explained later in the present description.

Figure 7:
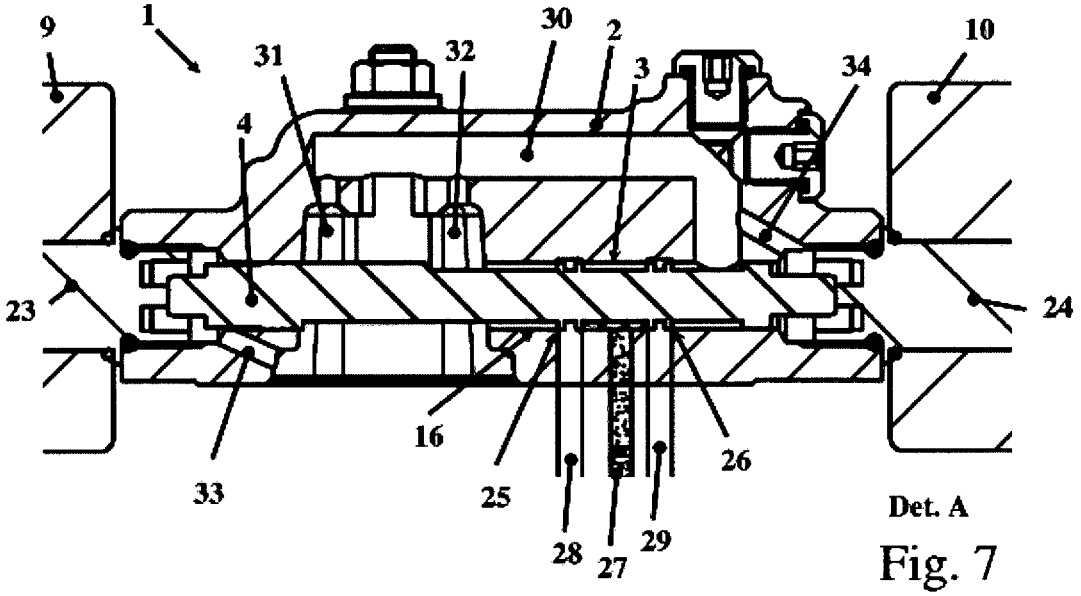
FIG. 7 is an enlargement of the portion indicated with A in FIG. 6.
Figure 8:
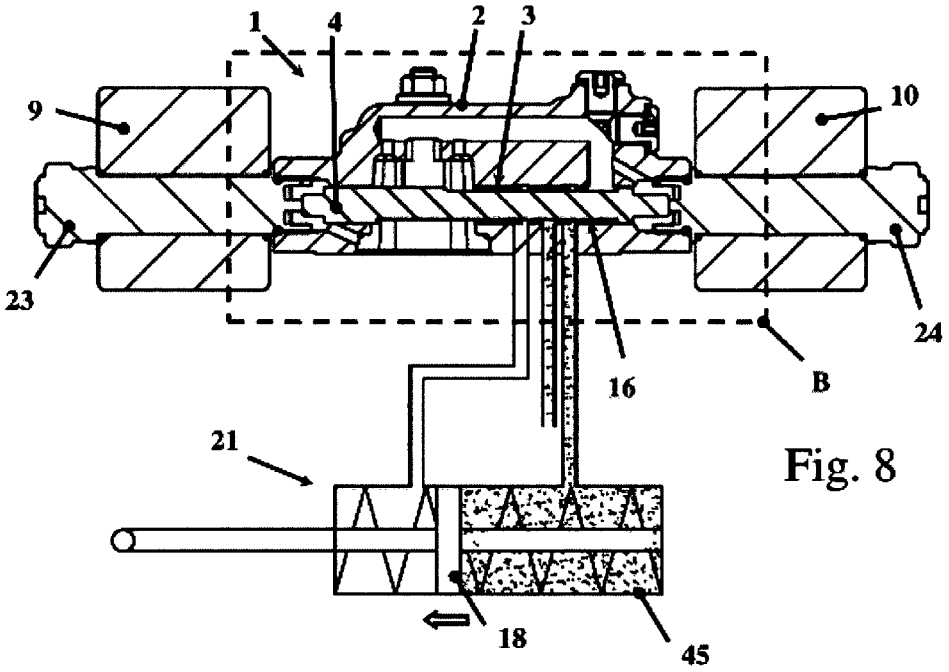
FIG. 8 represents a part of the control system of the inventive variable displacement hydraulic pump and related control in a first operating condition.
Figure 9:
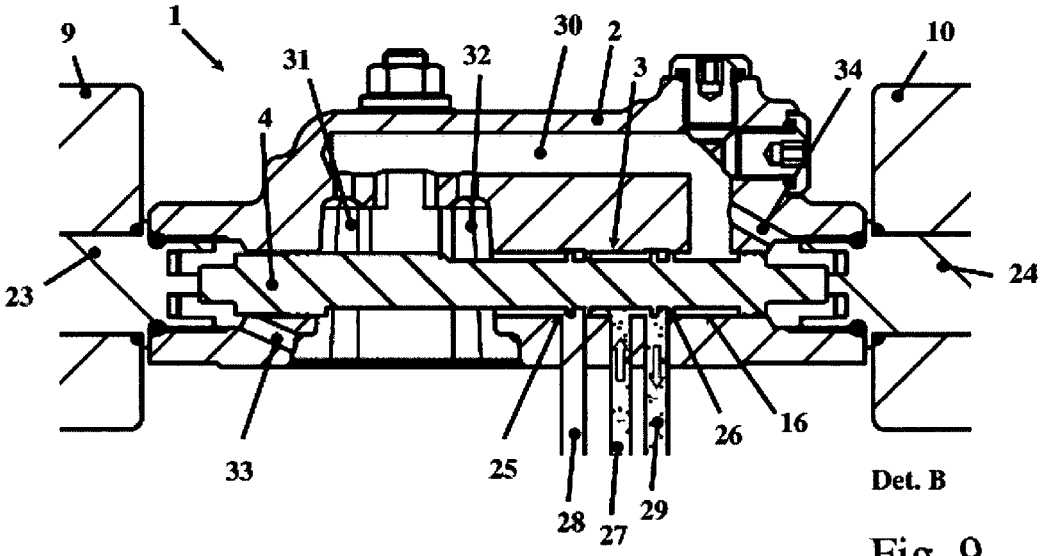
FIG. 9 is an enlargement of the portion indicated with B in FIG. 7.
Figure 10:
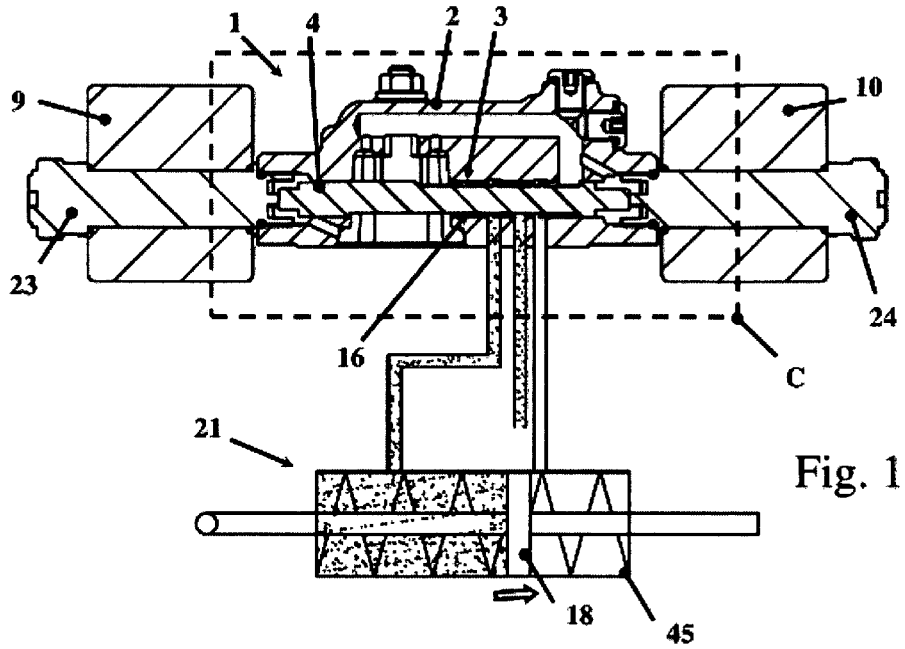
FIG. 10 represents a part of the control system of the inventive variable displacement hydraulic pump and related control in a second operating condition.
Figure 11:
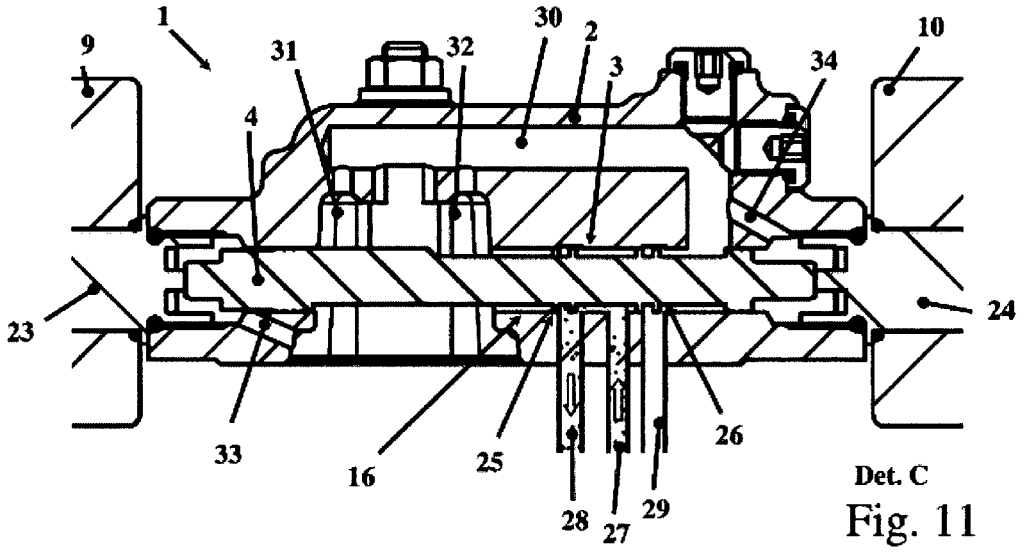
FIG. 11 is an enlargement of the portion indicated with C in FIG. 10.
Figure 12:
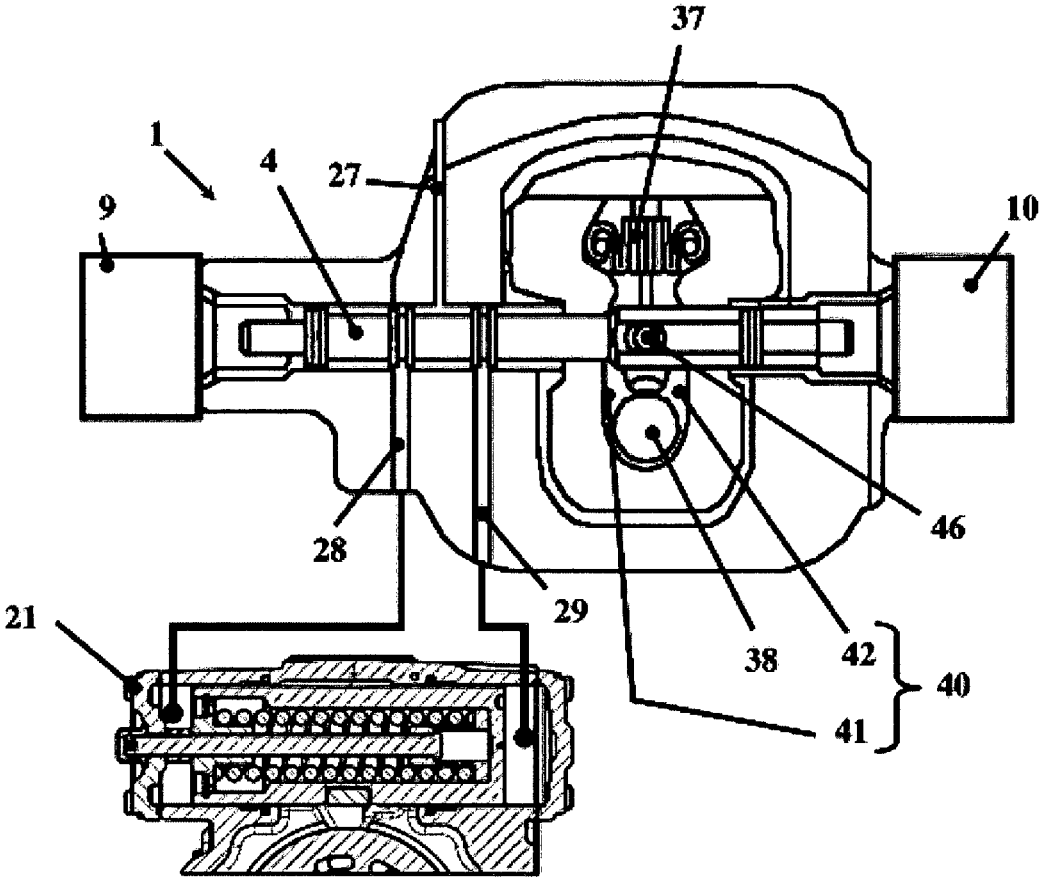
FIG. 12 illustrates a rest condition of the inventive system.

With reference to the functioning of the system (FIG. 6, FIG. 7, FIG. 8, FIG. 9, FIG. 10, FIG. 11) in a rest condition (FIG. 6, FIG. 7, FIG. 12) the first solenoid (9) and second solenoid (10) are not current controlled by the control unit (17) and the main spool (4) is kept in neutral central position with fluid transfer block between an inlet conduit (27) and control conduits (28, 29). In this way the displacement variation device (21) remains in neutral position. Blocking takes place through:

- a first blocking element (26) which blocks the flow communication of the interstice (16) between the inlet conduit (27) and a first control conduit (29)
- a second blocking element (25) which blocks the flow communication of an interstice (16) between the inlet conduit (27) and a second control conduit (28).

The first blocking element (26) and the second blocking element (25) have a shape with a double annular protrusion obtained on the main spool with the formation of a double tooth which closes the respective conduit on both sides of the conduit itself. The main spool (4) is inserted in a seat (3) with formation of the interstice (16) which serves to put in flow communication the inlet conduit (27) for oil under pressure alternatively with a first control conduit (29) or a second control conduit (28). In this condition (FIG. 12), the main spool (4) is in the neutral position and the charge pressure of the fluid, that is of the oil, is not transferred to the displacement variation device (21). For example, the charge pressure in the inlet conduit (27) may be of the order of 28 bars at 2000 rpm and in the rest condition in the first conduit (29) and in the second conduit (28) there may be a maximum discharge pressure of about 2 bars.

Figure 13:
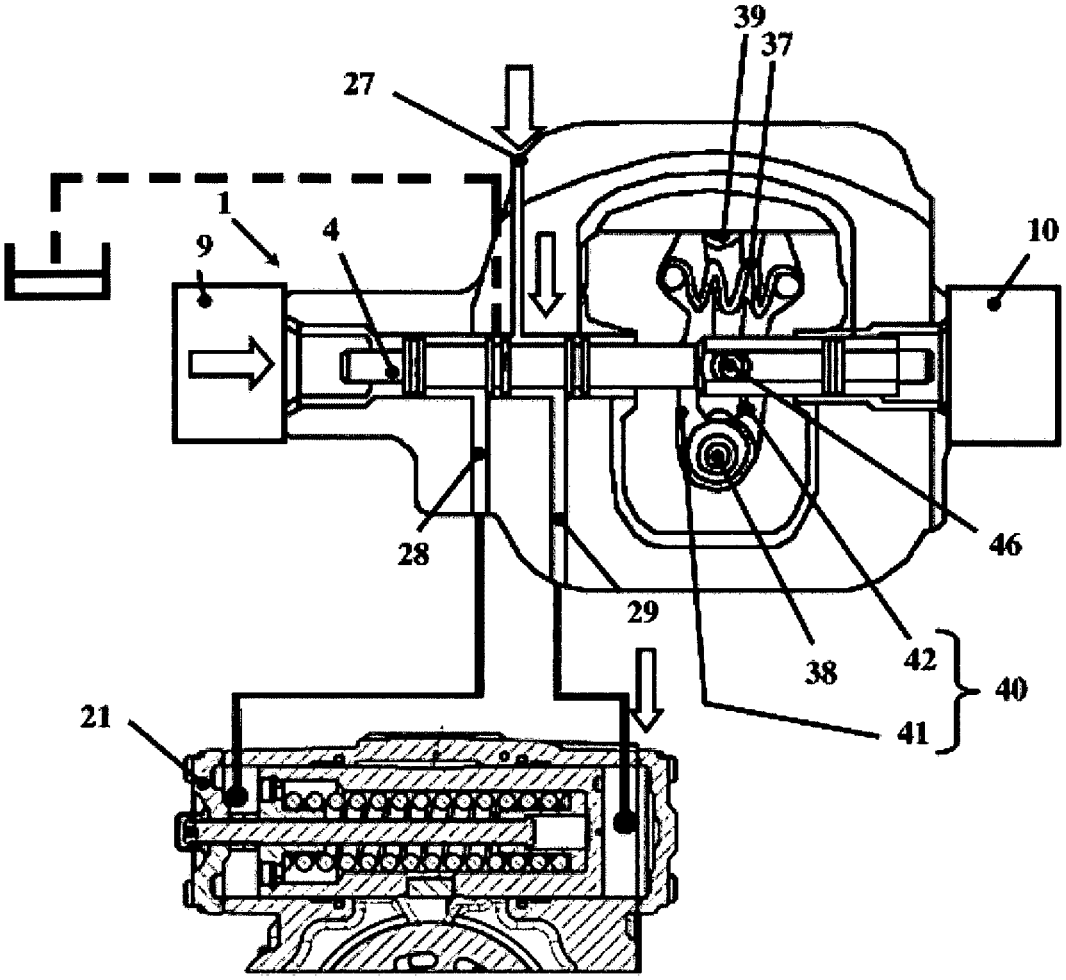
FIG. 13 illustrates the command of the inventive system in a first direction and in a first operating condition.
Figure 14:
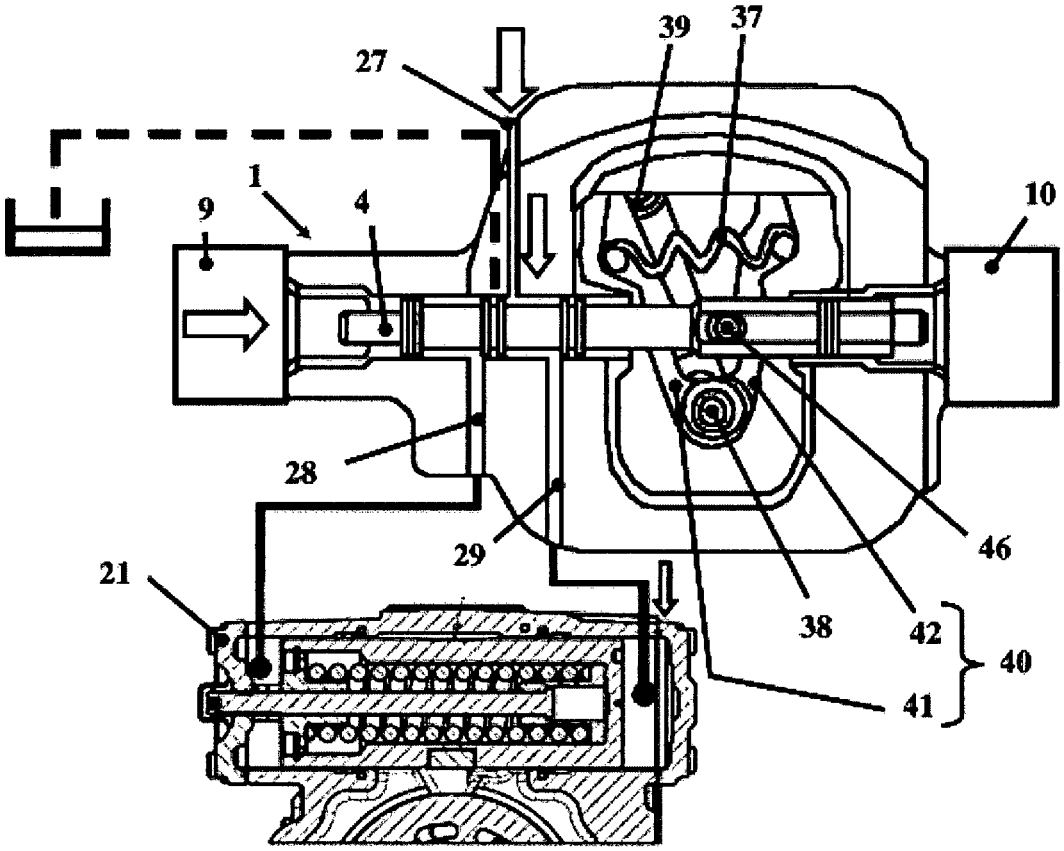
FIG. 14 illustrates the command of the inventive system in a first direction and in a second operating condition.
Figure 16:
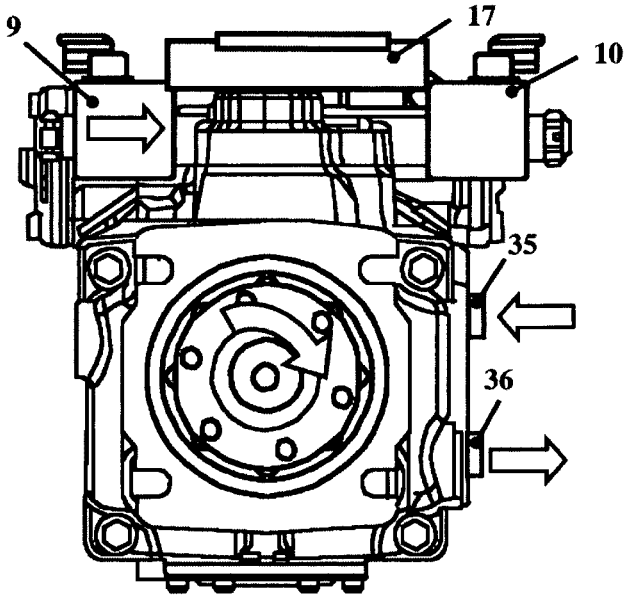
FIG. 16 schematically illustrates the command of the inventive system in a first direction.

In a first operating condition (FIG. 8, FIG. 9) the first solenoid (9) is current controlled by the control unit (17) while the second solenoid (10) is not controlled. In this condition the main spool (4) is displaced with respect to the neutral central position in such a way as to create a flow communication through the interstice (16) between the inlet conduit (27) and the first control conduit (29). In this way, the displacement variation device (21), which is a double-acting cylinder (45) with a through rod, is controlled by the fluid which penetrates a first half-portion of a cylinder (45) separated by a piston (18), moving the piston (18) which is connected to the pump to control the displacement increase in a first direction, indicating this condition with positive displacement. The first solenoid (9), following its activation by the control unit (17), causes the main spool (4) to move (FIG. 8, FIG. 9) to the right in the figure (FIG. 9) opening the communication between the inlet conduit (27) for oil under pressure and the first conduit (29). Consequently, the movement (FIG. 8) of the displacement control device (21) occurs in a first corresponding movement direction. In this configuration (FIG. 16), with the same direction of rotation of the pump, there is a first configuration of flow direction in a first port (35) and second port (36). For example, in the case of an exemplary and non-limitative application on a concrete mixer, this first flow direction configuration in first port (35) and second port (36) causes the rotation of the drum in a first direction of rotation of the drum. The higher the command current delivered by the control unit (17), based on the command given by the operator via the remote control device (11), the higher the displacement set on the pump and the higher the rotation speed in the first direction. The main spool (4) is connected (FIG. 12, FIG. 13, FIG. 14) to a fork (40) comprising a first arm (41) and a second arm (42) which are hinged at a fulcrum point (38) and are equipped with a return spring (37). Following the movement of the main spool (4), the arms (41, 42) are reciprocally spaced apart with loading of the spring (37). The final position is determined by a condition of balance between the force applied by the first solenoid (9) and the return force of the spring (37). On the system of the fork (40) there is a device for detecting the position (39) of the servo-control piston (18) which generates a feedback for reaching the displacement actually set in the first operating condition corresponding to the first configuration of the flows in the ports consisting of first port (35) and second port (36). In this case, to indicate that the flow control takes place in the first configuration between first port (35) and second port (36), this displacement is indicated as positive displacement. In this way the control unit (17) sets command current outputs depending on the feedback of the position detection device (39) and this feedback is relative to the real position of the servo-control device thus corresponding to a feedback relative to the real positive displacement set in the first operating condition corresponding to the rotation in the first direction. On the basis of this feedback, the control unit (17) can control the control current of the first solenoid (9) until the desired real position of the servo-command device and, therefore of the main spool (4), is reached, setting the desired positive displacement independently of the phenomena of thermal drift of the solenoid or aging of the components. Furthermore, in this way it is also possible to have a feedback signal which indicates the reaching of the return to the stop condition. When the stop command is given, the delivery of current on the first solenoid (9) is interrupted, the force is interrupted exerted by the first solenoid on the main spool (4), which, under the action of the spring (37) returns to the initial position, stopping the pump.

Figure 15:
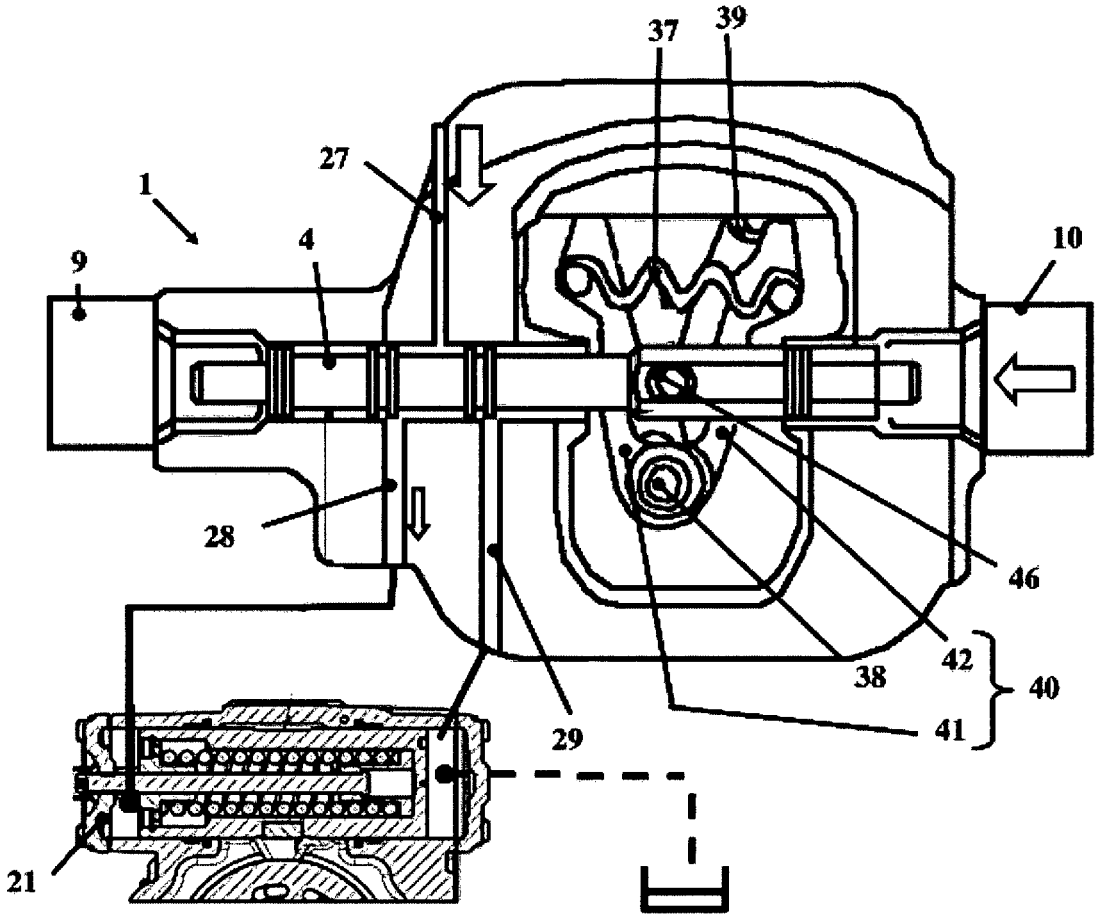
FIG. 15 illustrates the command of the inventive system in a second direction.
Figure 17:
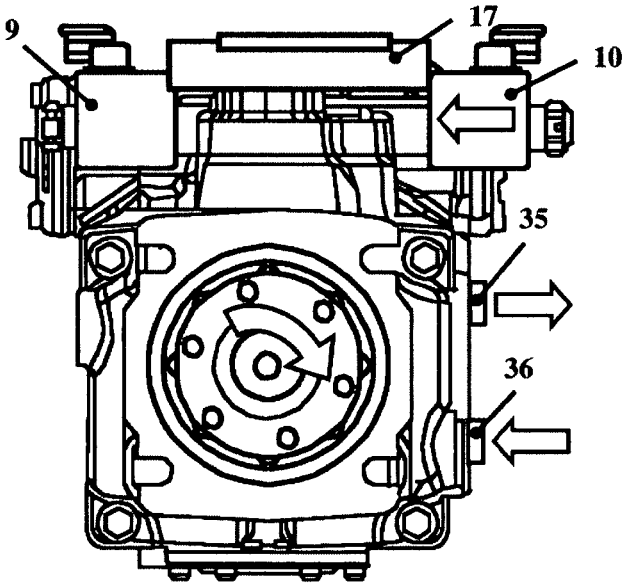
FIG. 17 schematically illustrates the command of the inventive system in a second direction.

In a second operating condition (FIG. 10, FIG. 11) the first solenoid (9) is not controlled while the second solenoid (10) is current controlled by the control unit (17). In this condition the main spool (4) is moved with respect to the neutral central position in such a way as to create a flow communication through the interstice (16) between the inlet conduit (27) and the second control conduit (28). In this way, the displacement variation device (21), which is a double-acting cylinder (45) with a through rod, is controlled by the fluid which penetrates a second half-portion of a cylinder (45) separated by a piston (18), moving the piston (18) which is connected to the pump to control the displacement increase in a second direction, indicating this condition as negative displacement. The second solenoid (10), following its activation by the control unit (17), causes the main spool (4) to move (FIG. 10, FIG. 11) to the left in the figure (FIG. 11) opening the communication between the inlet conduit (27) for oil under pressure and the second conduit (28). Consequently, the movement (FIG. 10) of the displacement control device (21) takes place in a corresponding second movement direction. In this configuration (FIG. 17) there is a second flow direction configuration in a first port (35) and second port (36), opposite to the configuration obtained by controlling the first solenoid (9). In this second configuration (FIG. 17) of flow direction in first port (35) and second port (36), with the same direction of rotation of the pump, there is a second configuration of flow direction in first port (35) and second port (36). For example, in the case of an exemplary and non-limitative application on a concrete mixer, this first flow direction configuration in first port (35) and second port (36) causes the drum to rotate in a second direction of rotation of the drum. The higher the control current delivered by the control unit (17), based on the command given by the operator through the remote control device (11), the higher the displacement set on the pump and the higher the rotation speed in the second direction. The main spool (4) is connected (FIG. 15) to the fork (40) comprising the first arm (41) and the second arm (42) which are hinged at the fulcrum point (38) and are equipped with the previously described return spring (37). Following the movement of the main spool (4), the arms (41, 42) are reciprocally spaced apart with loading of the spring (37). The final position is determined by a condition of balance between the force applied by the second solenoid (10) and the return force of the spring (37). On the system of the fork (40) there is the previously described position detection device (39) of the piston (18) of the servo-control device which generates a feedback for reaching the displacement actually set. In this case, to indicate that the flow control takes place in the second configuration between first port (35) and second port (36), this displacement is indicated as negative displacement. In this way the control unit (17) sets the control current outputs depending on the feedback of the position detection device (39) and this feedback is relative to the real position of the servo-control device, thus corresponding to a feedback relative to the real negative displacement set in the second operating condition corresponding to the rotation in the second direction. On the basis of this feedback, the control unit (17) can control the control current of the second solenoid (10) until the desired real position of the servo-control device and, therefore of the main spool (4), is reached, setting the desired negative displacement independently of the phenomena of thermal drift of the solenoid or aging of the components. Furthermore, in this way it is also possible to have a feedback signal which indicates the reaching of the return to the stop condition. When the stop command is given, the delivery of current on the second solenoid (10) is interrupted, the force is interrupted exerted by the second solenoid on the main spool (4), which, under the action of the spring (37) returns to the initial position, stopping the pump.

Figure 18:
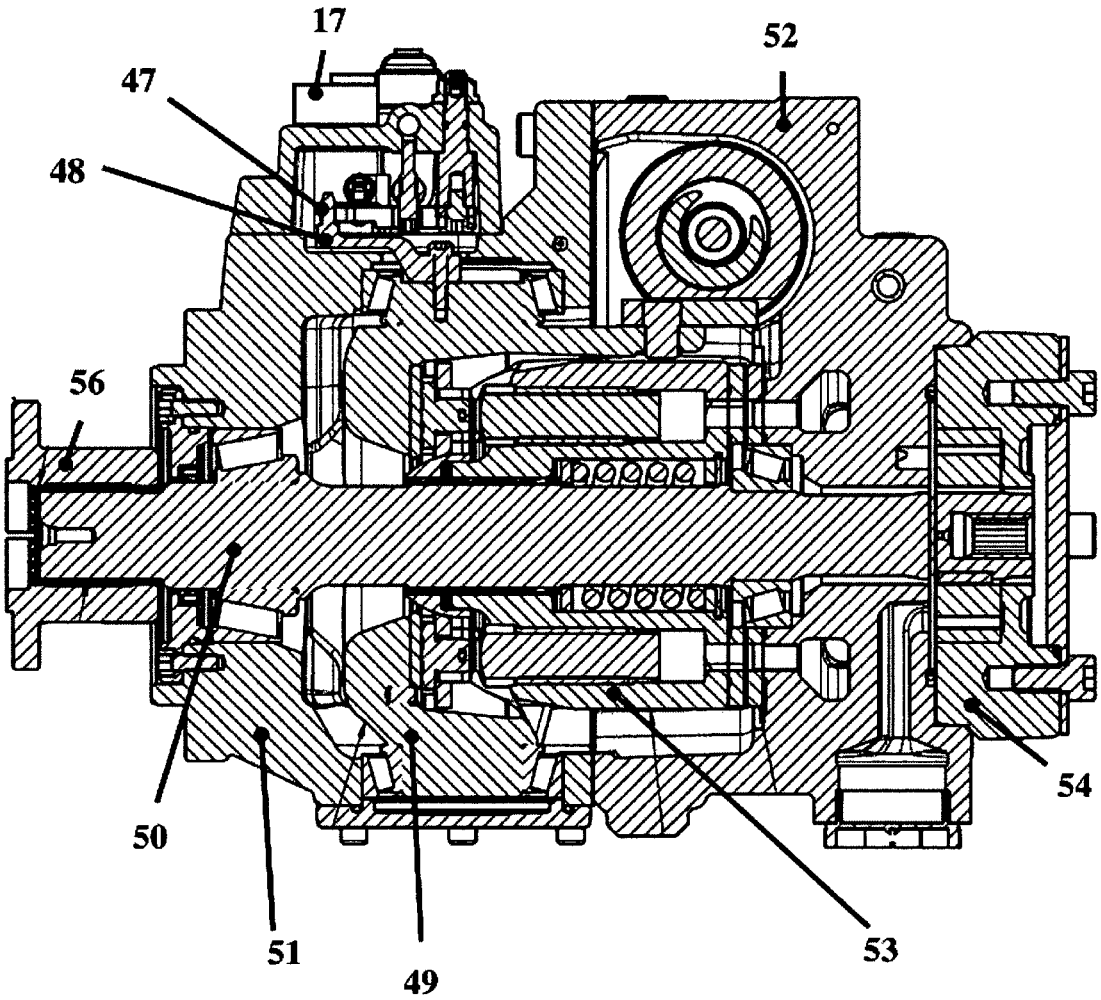
FIG. 18 illustrates a section of a part of the pump incorporating the inventive system.

With reference to the position detection device (39), it comprises (FIG. 18) a pin (47) which by means of a lever (48) is connected to the swash plate of the pump, the inclination of which defines the displacement of the pump itself.

Figure 19:
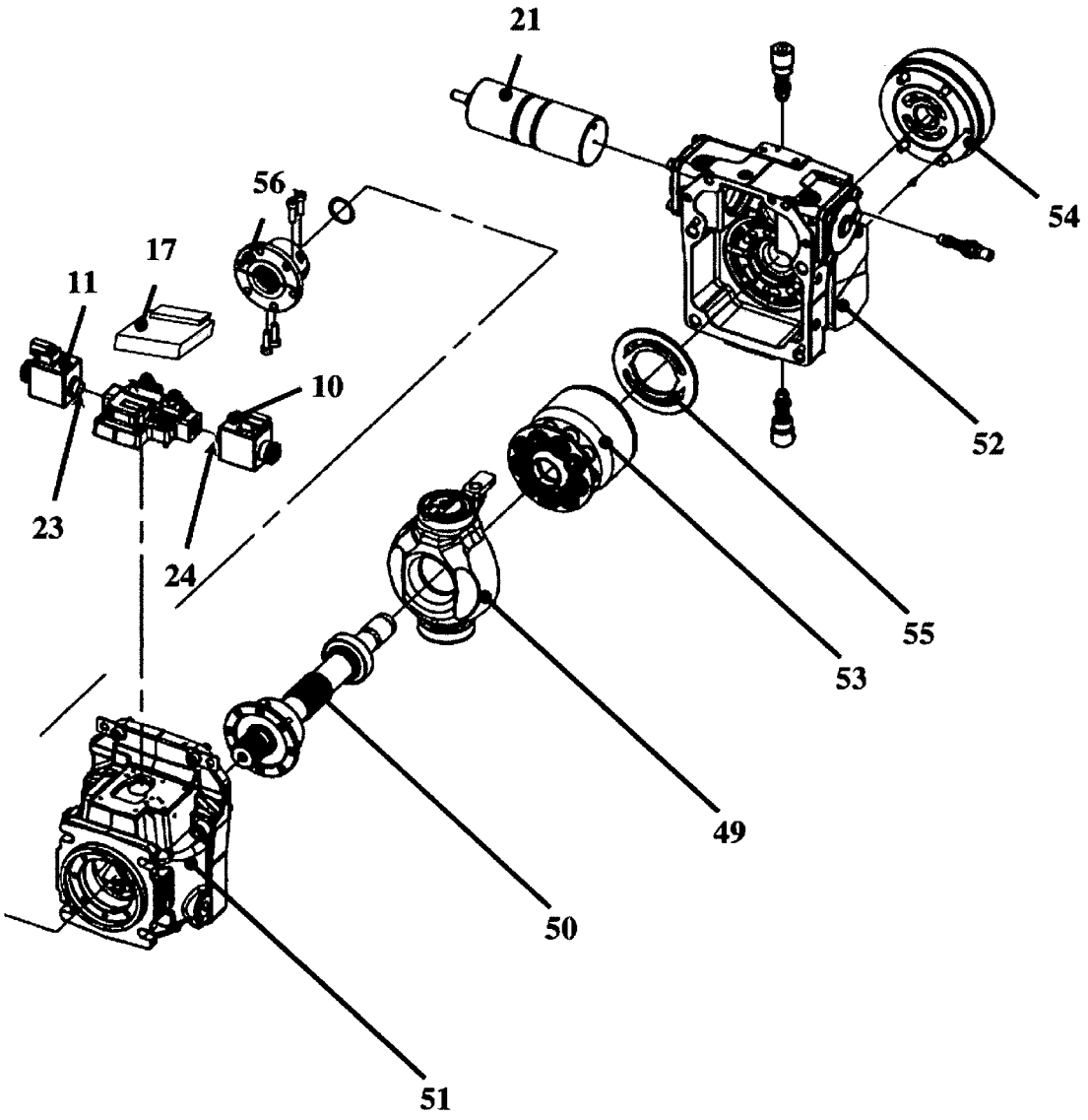
FIG. 19 is an exploded view of the pump incorporating the inventive system.

The pump (19) as a whole (FIG. 19) comprises a first half-casing (51) and a second half-casing (52) which enclose and support all the components of the pump including the plate assembly (49), the shaft (50), the rotor (53) associated with a corresponding auxiliary pump or pump of gerotor type (54), the distributor plate (55) and the flange (56).

With reference to the described functioning and to the remote control device (11), the displacement increase button (13') and a displacement decrease button (13") for adjusting the pump displacement allow the displacement to be increased or decreased by means of a command impulse in one direction or in the opposite direction.

For example, starting from a rest condition (FIG. 6, FIG. 7) repeatedly pressing the displacement increase button (13') will cause the activation of the first solenoid (9) and consequently there will be a progressive increase of the control current delivered by the control unit (17) to the first solenoid (9) obtaining a progressive movement of the main spool (4) to the right (FIG. 8, FIG. 9) with a corresponding progressive gradual increase in the displacement value, obtaining a positive displacement with gradually increasing module value. In this condition, by acting on the displacement decrease button (13"), the control current delivered by the control unit (17) to the first solenoid (9) will be reduced, obtaining a progressive movement of the main spool (4) towards the left (FIG. 8, FIG. 9) with corresponding progressive gradual reduction in the module value of the positive displacement down to zero. Further pressure actions on the displacement decrease button (13") once the neutral condition is reached, involve the activation of the second solenoid (10) and consequently there will be a progressive increase in the control current delivered by the control unit (17) to the second solenoid (10) obtaining a progressive movement of the main spool (4) towards the left (FIG. 10, FIG. 11) with a corresponding progressive gradual increase in the displacement value obtaining a negative displacement with a gradually increasing module value. In this condition, acting on the displacement increase button (13'), the control current delivered by the control unit (17) to the second solenoid (10) will be reduced, obtaining a progressive movement of the main spool (4) to the right (FIG. 10, FIG. 11) with corresponding progressive gradual reduction in the module value of the negative displacement down to zero.

Ultimately, the present invention refers to a control system (1, 17, 21) for a hydraulic pump (19) in which the pump is equipped with a displacement variation apparatus, the system (1, 17, 21) comprising a displacement variation control device (21) equipped with servo-control device with cylinder (45) and piston (18) provided with connection means to the displacement variation apparatus of the pump (19), the cylinder (45) comprising a first half-portion and a second half-portion separated by the piston (18) for delivery of a fluid under pressure for movement of the piston (18) respectively in a first movement direction and in a second movement direction opposite to the first direction. The system comprising a control unit (17), a driving valve (1) and a first solenoid (9) and a second solenoid (10) for controlling the valve (1). The control unit (17) includes a displacement increase input and a displacement decrease input, a first output connected to the first solenoid (9) and a second output connected to the second solenoid (10). The valve (1) comprises a body (2) equipped with conduits (27, 28, 29) for delivery of the fluid alternatively in the first half-portion or in the second half-portion of the cylinder (45), the valve (1) comprising a spool (4) which can be moved within a seat (3) between at least three positions, a neutral position for blocking the fluid flow towards the cylinder (45), a first position for delivery of the fluid to the first half-portion of the cylinder (45)), a second position for delivery of the fluid to the second half-portion of the cylinder (45), the spool (4) being connected to an elastic element (37) for return to the neutral position, the first solenoid (9) and the second solenoid (10) being current operated solenoids. The system (1, 17, 21) comprises a device (39) for position detection of the servo-control device for position feedback of the real position of the servo-control device, the control unit, (17) comprising a logic for control of current of first output and second output with dependency on the feedback of the position detection device (39).

Preferably the valve (1) comprises an inlet conduit (27) for the fluid under pressure, a first control conduit (29) and a second control conduit (28), the first control conduit (29) being connected in flow communication with the first half-portion of the cylinder (45) and the second control conduit (28) being connected in flow communication with the second half-portion of the cylinder (45), the inlet conduit (27) being positioned on the body of the valve (1) in a position between the first control conduit (29) and the second control conduit (28). The first solenoid (9) is positioned on an opposite side of the valve (1) with respect to the position of the second solenoid (10), the first solenoid (9) being configured in order to exert a pushing action for movement of the spool (4) in said first position for connection in flow communication between the inlet conduit (27) and the first control conduit (29), the second solenoid (10) being configured so as to exert an opposite pushing action for movement of the spool (4) in said second position, for connection in flow communication between the inlet conduit (27) and the second control conduit (28). The first solenoid (9) is controlled independently with respect to the second solenoid (10) for displacement increase and decrease commands in a first operating condition of the pump and the second solenoid (10) is controlled independently with respect to the first solenoid (9) for displacement increase and decrease commands in a second operating condition of the pump.

The displacement variation control device (21) is configured in such a way that the connecting means to the displacement variation apparatus of the pump (19) cause a reversal of the flow between a first port (35) and a second port (36) of the pump (19) for passage between a positive displacement corresponding to the first position of the spool (4) and a negative displacement corresponding to the second position of the spool (4) with reversal of the flow between the ports (35, 36) with maintenance of the same direction of rotation of the pump (19).

The first operating condition of the pump corresponds to the positive displacement under the independent control of the first solenoid (9) with respect to the second solenoid (10) and the second operating condition of the pump corresponds to said negative displacement under the independent control of the second solenoid (10) with respect to the first solenoid (9).

The first solenoid (9) is a proportional solenoid for exertion of a pushing action of the spool (4) towards the first position which is proportional to the control current of the first output of the control unit (17). The second solenoid (10) is a proportional solenoid for exertion of a pushing action of the spool (4) towards the second position which is proportional to the control current of the second output of the control unit (17).

The valve (1) includes an interstice (16) obtained in the space between the seat (3) and the spool (4) and the interstice (16) puts in communication the conduits (27, 28, 29), the spool (4) being equipped with flow blocking elements (25, 26) arranged in such a way that in the neutral position a first blocking element (26) blocks the flow communication between the inlet conduit (27) and the first control conduit (29) while a second blocking element (25) blocks the flow communication between the inlet conduit (27) and the second control conduit (28), in the first position for delivery of the fluid to the first half-portion of the cylinder (45) the first blocking element (26) being positioned in such a way as to put in flow communication the inlet conduit (27) and the first control conduit (29) through the interstice (16) while the second blocking element (25) blocks the flow communication between the inlet conduit (27) and the second control conduit (28), in the second position for delivery of the fluid to the second semi-portion of the cylinder (45) the second blocking element (25) being positioned in such a way as to put in flow communication the inlet conduit (27) and the second control conduit (28) through the interstice (16) while the first blocking element (26) blocks the flow communication between the inlet conduit (27) and the first control conduit (29). Preferably each one of first blocking element (26) and second blocking element (25) is composed of a double annular protrusion obtained on the spool (4) with formation of a double tooth which closes the respective conduit on both sides of the conduit itself when the spool (4) is in the neutral position, the double annular protrusion allowing the flow towards the respective conduit blocking the flow outside the interstice (16) connecting the conduits.

The cylinder (45) is a double-acting cylinder with through rod in which the through rod is integral with the piston (18), the rod constituting said connection means to the displacement variation apparatus of the pump (19).

The device (39) for detecting the position of the servo-control device comprises a pin (47) which is connected by means of a lever (48) to the servo-control device in such a way that a movement of the pin (47) corresponds to a movement of the servo-control device.

The elastic element (37) for return to the neutral position is applied between a couple of arms (41, 42) equipped with a fulcrum point (38), the spool (4) being equipped with an engagement element (46) with the couple of arms (41, 42) for movement integral with the spool (4) of at least one between the arms of the couple of arms (41, 42) which are preferably arranged so as to form a fork.

The pin (47) is in contact condition with said couple of arms (41, 42) so that a movement of the pin (47) corresponds to a movement of the servo-control device with a corresponding increase in the reciprocal distance of the couple of arms (41, 42) according to the position of the servo-control device, said reciprocal distance of the couple of arms (41, 42) by means of said pin (47) constituting said position feedback of the real position of the servo-control device. In this way the control unit sends the command to one of the two solenoids (9, 10), the corresponding solenoid commands its own valve to control the movement of the spool (4) which acts on the servo-control device. The lever is moved with the servo-control device and causes the movement of the pin (47) which intervenes on the arms by acting in turn on the elastic element whose force exerted to the spool (4) is consequently modified just as if it were a mechanic feedback. The control unit will then intervene controlling the output current to bring the solenoid to the desired balance condition with the spring corresponding to a certain output current, realizing the feedback.

The system may further comprise a temperature sensor for detecting the pump temperature, the control unit (17) being equipped with a further input for a temperature signal from the pump temperature sensor and a temperature control logic for generation of alarm signals and/or for reduction or blocking of the pump speed in the case in which the detected temperature is higher than an intervention threshold. The control unit (17) can thus be made in the form of an electronic card integrated on the body of the pump (19), the temperature sensor for temperature detection being mounted on the card and the card being mounted in contact condition with the body of the pump so that the temperature sensor is in direct contact with the body of the pump itself.

The system can comprise a remote control device (11) equipped with a communication channel with the control unit (17), the remote control device (11) comprising at least one interface element with the operator for control of increase of displacement (13') and an interface element with the operator for control of decrease of displacement (13"), in which the interface element with the operator for control of increase of displacement (13') is connected through said communication channel with the displacement increase input of the control unit (17) and the interface element with the operator for control of decrease of displacement (13") is connected through said communication channel with the displacement decrease input of the control unit (17). For example, the remote control device (11) can comprise status indicators (8) for visualization of status signals and alarm signals, the status indicators (8) being connected through said communication channel with corresponding signal outputs of the control unit (17). The status indicators (8) are selected among light indicators and a visualization display for visualization of the signals of the signal outputs of the control unit (17). The communication channel is selected among wireless communication channel, wired communication channel, communication channel realized in the form of a serial communication bus. The remote control device (11) can be made in the form of a touch screen device equipped with an application or program for processor constituting a man-machine interface.

The present invention also relates to a control method of a hydraulic pump (19) in which the pump is equipped with a displacement variation apparatus and a control system (1, 17, 21), the system (1, 17, 21) comprising a displacement variation control device (21) equipped with a servo-control device with a cylinder (45) comprising a piston (18) provided with connection means to the displacement variation apparatus of the pump (19), the cylinder (45) comprising a first half-portion and a second half-portion separated by the piston (18) for delivery of a fluid under pressure for movement of the piston (18) respectively in a first movement direction and in a second movement direction opposite to the first direction, the system comprising a control unit (17), an driving valve (1) and a first solenoid (9) and a second solenoid (10) for controlling the valve (1), the control unit (17) comprising a displacement increase input and a displacement decrease input, a first output connected to the first solenoid (9) and a second output connected to the second solenoid (10), the method comprising the following steps:

- reception of the displacement variation command by an operator, the displacement variation command being selected between displacement increase command and displacement decrease command;
- activation of corresponding displacement variation command inputs of the control unit (17), in which the displacement increase command causes the activation of the displacement increase input of the control unit (17) and the displacement decrease command causes the activation of the displacement decrease input of the control unit (17);

elaboration of the displacement variation command by the control unit (17);

activation of corresponding displacement variation control outputs of the control unit (17).

In the system described the valve (1) comprises a body (2) equipped with conduits (27, 28, 29) for delivery of the fluid alternatively in the first half-portion or in the second half-portion of the cylinder (45), the valve (1) comprising a spool (4) which can be moved within a seat (3) between at least three positions, of which a neutral position for blocking the fluid flow towards the cylinder (45), a first position for delivery of the fluid to the first half-portion of the cylinder (45), a second position for delivery of the fluid to the second half-portion of the cylinder (45), the spool (4) being connected to an elastic element (37) for return to the neutral position, the first solenoid (9) and the second solenoid (10) being current controlled solenoids, the system (1, 17, 21) comprising a position detection device (39) of the servo-control device for position feedback of the real position of the servo-control device, the control unit (17) comprising a logic for current control of first output and second output with dependency on the feedback of the position detection device (39), wherein the method comprises a control phase of the current of first output and second output depending on the feedback of the position detection device (39) of the servo-control device for setting the real position of the servo-control device.

In the method described:

if the spool (4) is in the neutral position, the activation phase of corresponding displacement variation command outputs of the control unit (17) is an increase phase of the control current of the first solenoid (9) in the case in which the receiving phase of displacement variation command is a receiving phase of a displacement increase command;

if the spool (4) is in the neutral position, the activation phase of corresponding displacement variation command outputs of the control unit (17) is an increase phase of the control current of the second solenoid (9) in the case in which the receiving phase of displacement variation command is a receiving phase of a displacement decrease command.

In the method described:

if the spool (4) is in the first position, the activation phase of corresponding displacement variation command outputs of the control unit (17) is an increase phase of the control current of the first solenoid (9) in the case in which the receiving phase of displacement variation command is a receiving phase of a displacement increase command;

if the spool (4) is in the first position, the activation phase of corresponding displacement variation command outputs of the control unit (17) is a decrease phase of the control current of the first solenoid (10) in the case in which the receiving phase of displacement variation command is a receiving phase of a displacement decrease command.

In the method described:

if the spool (4) is in the second position, the activation phase of corresponding displacement variation command outputs of the control unit (17) is a decrease phase of the control current of the second solenoid (10) in the case in which the receiving phase of displacement variation command is a receiving phase of a displacement increase command;

if the spool (4) is in the second position, the activation phase of the corresponding displacement variation command outputs of the control unit (17) is an increase phase of the control current of the second solenoid (10) in the case in which the receiving phase of displacement variation command is a receiving phase of a displacement decrease command.

The method may further comprise a phase of acquiring the pump temperature by means of the temperature sensor for detection of the pump temperature, and a phase of verification of the pump temperature with a further phase of generating alarm signals and/or reduction or blocking phases of the pump speed in the case in which the detected temperature is higher than an intervention threshold.

The present invention also refers to a hydraulic pump (19) in which the described control system is integrated on the structure of the pump, for example at the head of the pump in an intermediate position between the two control solenoids.

The present invention also refers to a hydraulic pump (19) of the type equipped with a displacement variation apparatus, in which the pump (19) comprises a displacement variation apparatus of the pump (19), the pump being equipped with a control system (1, 17, 21) comprising a displacement variation control device (21), the system being equipped with a servo-control device with cylinder (45) comprising a piston (18) provided with connection means to the displacement variation apparatus of the pump (19), the cylinder (45) comprising a first half-portion and a second half-portion separated by the piston (18) for delivery of a fluid under pressure for movement of the piston (18) respectively in a first movement direction and in a second movement direction opposite to the first direction, the system comprising a control unit (17), a driving valve (1) and a first solenoid (9) and a second solenoid (10) for controlling the valve (1), the control unit (17) comprising a displacement increase input and a displacement decrease input, a first output connected to the first solenoid (9) and a second output connected to the second solenoid (10) wherein the control system (1, 17, 21) is made as described. The control unit (17) can contain a program for processor implementing a control method of a hydraulic pump (19) as described.

The description of the present invention has been made with reference to the enclosed figures in a preferred embodiment of it, but it is evident that a lot of possible changes, modifications and variations will be immediately clear to those skilled in the art in the light of the preceding description. Thus, it must be underlined that the invention is not limited to the previous description, but it includes all the changes, modifications and variations in accordance with the appended claims.

NOMENCLATURE USED

With reference to the identification numbers present in the enclosed figures, the following nomenclature has been used:

1. Driving valve
2. Body
3. Seat
4. Main spool
5. Stop solenoid
6. Control valve
7. Handle
8. Status indicators

9. First solenoid
10. Second solenoid
11. Remote control device
12. Emergency button
13'. Displacement increase button
13" Displacement decrease button
14. Charge/discharge command handle grip
15. Rotation direction command handle grip
16. Interstice
17. Control unit
18. Piston
19. Hydraulic pump or variable displacement pump
20. Control system
21. Control device for variation of displacement
22. Bypass valve
23. First valve
24. Second valve
25. Second blocking element
26. First blocking element
27. Inlet conduit
28. Second control conduit
29. First control conduit
30. Third discharge conduit
31. Fourth discharge conduit
32. Fifth discharge conduit
33. First discharge conduit
34. Second discharge conduit
35. First port
36. Second port
37. Spring or elastic element
38. Fulcrum
39. Position detection device
40. Fork
41. First arm
42. Second arm
43. Displacement increase solenoid
44. Displacement decrease solenoid
45. Cylinder
46. Engagement element
47. Pin
48. Lever
49. Plate assembly
50. Shaft
51. First half-casing
52. Second half-casing
53. Rotor
54. Auxiliary pump or pump of gerotor type
55. Distributor plate
56. Flange

The invention claimed is:

1. Control system for a hydraulic pump in which the pump is provided with a displacement variation apparatus, the system comprising a control device for variation of displacement provided with a servo-control device with a cylinder and a piston provided with connection means to the displacement variation apparatus of the pump, the cylinder comprising a first semi-portion and a second semi-portion separated by the piston for delivery of a fluid under pressure for movement of the piston respectively in a first movement direction and in a second movement direction opposite to the first direction, the system comprising a control unit, a driving valve and a first solenoid and a second solenoid for control of the valve, the control unit comprising a displacement increase input and a displacement decrease input, a first output connected to the first solenoid and a second output connected to the second solenoid wherein the valve includes a body provided with conduits for delivery of the fluid alternatively in the first semi-portion or in the second semi-portion of the cylinder, the valve comprising a spool which is movable within a seat between at least three positions, a neutral position for blocking the fluid flow towards the cylinder, a first position for delivery of the fluid to the first semi-portion of the cylinder, a second position for delivery of the fluid to the second semi-portion of the cylinder, the spool being connected to an elastic element for return to the neutral position, the first solenoid and the second solenoid being current controlled solenoids, the system comprising a position detection device of the servo-control device for position feedback of the real position of the servo-control device, the control unit comprising a logic for current control of first output and second output with a dependency on the feedback of the position detection device, wherein the position detection device of the servo-control device comprises a pin which is connected to the servo-control device by means of a lever in such a way that a movement of the pin corresponds to a movement of the servo-control device, the elastic element for return to the neutral position being applied between a couple of arms provided with a fulcrum point, the spool being provided with an engagement element with the couple of arms for movement integral with the spool of at least one between the arms of the couple of arms and wherein the pin is in a contact condition with said couple of arms so that a movement of the pin corresponds to a movement of the piston of the servo-control device with corresponding increase of reciprocal distance of the couple of arms according to the position of the servo-control device, said reciprocal distance of the couple of arms by means of said pin constituting said position feedback of the real position of the servo-control device.

2. Control system for a hydraulic pump according to claim 1, wherein the valve comprises an inlet conduit of the fluid under pressure, a first control conduit and a second control conduit, the first control conduit being connected in flow communication to the first semi-portion of the cylinder and the second control conduit being connected in flow communication to the second semi-portion of the cylinder, the inlet conduit being located on the body of the valve in a position between the first control conduit and the second control conduit.

3. Control system for a hydraulic pump according to claim 2, wherein the first solenoid is located on an opposite side of the valve with respect to the position of the second solenoid, the first solenoid being configured so as to exert a pushing action for movement of the spool in said first position for connection in flow communication between the inlet conduit and the first control conduit, the second solenoid being configured so as to exert an opposite pushing action for movement of the spool in said second position, for connection in flow communication between the inlet conduit and the second control conduit.

4. Control system for a hydraulic pump according to claim 3, wherein the first solenoid is independently controlled with respect to the second solenoid for control commands for increase and decrease of displacement in a first operating condition of the pump and the second solenoid is independently controlled with respect to the first solenoid for commands for increase and decrease of displacement in a second operating condition of the pump.

5. Control system for a hydraulic pump according to claim 4, wherein the control device for variation of displacement is configured in such a way that the connection means to the displacement variation apparatus of the pump cause a reversal of the flow between a first port and a second port of the pump for passage between a positive displacement corresponding to the first position of the spool and a negative displacement corresponding to the second position of the spool with reversal of the flow between the ports with maintenance of a same direction of rotation of the pump.

6. Control system for a hydraulic pump according to claim 5, wherein the first operating condition of the pump corresponds to said positive displacement under the independent control of the first solenoid with respect to the second solenoid and the second operating condition of the pump corresponds to said negative displacement under the independent control of the second solenoid with respect to the first solenoid.

7. Control system for a hydraulic pump according to claim 3, wherein the first solenoid is a proportional solenoid for exertion of a pushing action of the spool towards the first position which is proportional to the control current of the first output of the control unit.

8. Control system for hydraulic pump according to claim 3, wherein the second solenoid is a proportional solenoid for exertion of a pushing action of the spool towards the second position which is proportional to the control current of the second output of the control unit.

9. Control system for a hydraulic pump according claim 8, wherein the valve comprises an interstice obtained in the space between the seat and the spool and the interstice puts in flow communication the conduits, the spool being provided with blocking elements of the flow located in such a way that in the neutral position a first blocking element blocks the flow communication between the inlet conduit and the first control conduit while a second blocking element blocks the flow communication between the inlet conduit and the second control conduit, in the first position for delivery of the fluid to the first semi-portion of the cylinder the first blocking element being placed in such a way as to put in flow communication the inlet conduit and the first control conduit by means of the interstice while the second blocking element blocks the flow communication between the inlet conduit and the second control conduit, in the second position for delivery of the fluid to the second semi-portion of the cylinder the second blocking element being placed in such a way as to put in flow communication the inlet conduit and the second control conduit by means of the interstice while the first blocking element blocks the flow communication between the inlet conduit and the first control conduit.

10. Control system for a hydraulic pump according to claim 9, wherein each one between first blocking element and second blocking element consists of a double annular protrusion obtained on the spool with formation of a double tooth which closes the respective conduit on both sides of the conduit itself when the spool is in the neutral position, the double annular protrusion allowing the flow towards the respective conduit blocking the flow outside the interstice connecting the conduits.

11. Control system for a hydraulic pump according to claim 1, wherein the cylinder is a double-acting cylinder with through rod in which the through rod is integral with the piston, the rod constituting said connection means to the displacement variation apparatus of the pump.

12. Control system for a hydraulic pump according to claim 1, further comprising a temperature sensor for detection of the temperature of the pump, the control unit being provided with an additional input for a temperature signal from the temperature sensor of the pump and with a logic for temperature control for generation of alarm signals and/or for reducing or stopping the speed of the pump in the case in which the detected temperature is higher than an intervention threshold.

13. Control system for a hydraulic pump according to claim 12, wherein the control unit is made in the form of an electronic card integrated on the body of the pump, the temperature sensor for detection of the temperature being mounted on the card and the card being mounted in contact condition with the body of the pump in such a way that the temperature sensor is in direct contact with the body of the pump itself.

14. Control system for a hydraulic pump according to claim 1, further comprising a remote control device provided with a communication channel with the control unit, the remote control device comprising at least one interface element with the operator for control of increase of displacement and an interface element with the operator for control of decrease of displacement, in which the interface element with the operator for control of increase of displacement is connected by means of said communication channel with the displacement increase input of the control unit and the interface element with the operator for control of decrease of displacement is connected by means of said communication channel with the displacement decrease input of the control unit.

15. Control system for a hydraulic pump according to claim 14, wherein the remote control device includes status indicators for visualization of status signals and alarm signals, the status indicators being connected by means of said communication channel with corresponding signal outputs of the control unit.

16. Control system for a hydraulic pump according to claim 15, wherein the status indicators are selected between light indicators and a visualization display for visualization of the signals of the signal outputs of the control unit.

17. Control system for a hydraulic pump according to claim 14, wherein the communication channel is selected between wireless communication channel, wired communication channel, communication channel made in the form of serial communication bus.

18. Control system for a hydraulic pump according to claim 14, wherein the remote control device is made in the form of a touch screen device provided with application or program for processor constituting a human-machine interface.

19. Control method of a hydraulic pump in which the pump is provided with a displacement variation apparatus and with a control system, wherein the control system for hydraulic pump is made according to claim 1, the method comprising the following steps:

reception of a displacement variation command by an operator, the displacement variation command being selected between displacement increase command and displacement decrease command;

activation of corresponding displacement variation control inputs of the control unit, in which the displacement increase command causes the activation of the displacement increase input of the control unit and the displacement decrease command causes the activation of the displacement decrease input of the control unit;

elaboration of the displacement variation command by the control unit;

activation of corresponding displacement variation control outputs of the control unit;

wherein the valve includes a body provided with conduits for delivery of the fluid alternatively in the first semi-portion or in the second semi-portion of the cylinder, the valve comprising a spool which is movable within a seat between at least three positions of which a neutral position for blocking the fluid flow towards the cylinder, a first position for delivery of the fluid to the first semi-portion of the cylinder, a second position for delivery of the fluid to the second semi-portion of the cylinder, the spool being connected to an elastic element for return to the neutral position, the first solenoid and the second solenoid being current controlled solenoids, the system comprising a position detection device of the servo-control device for position feedback of the real position of the servo-control device, the control unit comprising a logic for current control of first output and second output with a dependency on the feedback of the position detection device, in which the method includes a control phase of the current of first output and second output depending on the feedback of the position detection device of the servo-control device for setting the real position of the servo-control device.

20. Control method of a hydraulic pump according to claim 19, wherein:

if the spool is in the neutral position, the activation phase of corresponding displacement variation control outputs of the control unit is an increase phase of the control current of the first solenoid in the case in which the receiving phase of displacement variation command is a receiving phase of a displacement increase command;

if the spool is in the neutral position, the activation phase of corresponding displacement variation control outputs of the control unit is an increase phase of the control current of the second solenoid in the case in which the receiving phase of displacement variation command is a receiving phase of a displacement decrease command.

21. Control method of a hydraulic pump (19) according to claim 19, wherein:

if the spool is in the first position, the activation phase of corresponding displacement variation control outputs of the control unit is an increase phase of the control current of the first solenoid in the case in which the receiving phase of displacement variation command is a receiving phase of a displacement increase command;

if the spool is in the first position, the activation phase of corresponding displacement variation control outputs of the control unit is a decrease phase of the control current of the first solenoid in the case in which the receiving phase of displacement variation command is a receiving phase of a displacement decrease command.

22. Control method of a hydraulic pump according to claim 19, wherein:

if the spool is in the second position, the activation phase of corresponding displacement variation control outputs of the control unit is a decrease phase of the control current of the second solenoid in the case in which the receiving phase of displacement variation command is a receiving phase of a displacement increase command;

if the spool is in the second position, the activation phase of corresponding displacement variation control outputs of the control unit is an increase phase of the control current of the second solenoid in the case in which the receiving phase of displacement variation command is a receiving phase of a displacement decrease command.

23. Control method of a hydraulic pump according to claim 19, wherein the control system for the hydraulic pump further comprises a temperature sensor for detection of the temperature of the pump, the control unit being provided with an additional input for a temperature signal from the temperature sensor of the pump and with a logic for temperature control for generation of alarm signals and/or for reducing or stopping the speed of the pump in the case in which the detected temperature is higher than an intervention threshold, wherein the method further includes an acquisition phase of the temperature of the pump by means of the temperature sensor for detection of the temperature of the pump, and a verification phase of the temperature of the pump with an additional generation phase of alarm signals and/or reduction or blocking phases of the speed of the pump in the case in which the detected temperature is higher than an intervention threshold.

24. Hydraulic pump of the type provided with a displacement variation apparatus, in which the pump includes a displacement variation apparatus the pump, the pump being provided with a control system comprising a control device for variation of displacement, wherein the control system is made according to claim 1, and is integrated on the pump structure.

25. Hydraulic pump of the type provided with a displacement variation apparatus according to claim 24, wherein the control unit contains a program for processor implementing a control method of a hydraulic pump comprising the following steps:

reception of a displacement variation command by an operator, the displacement variation command being selected between displacement increase command and displacement decrease command;

activation of corresponding displacement variation control inputs of the control unit, in which the displacement increase command causes the activation of the displacement increase input of the control unit and the displacement decrease command causes the activation of the displacement decrease input of the control unit;

elaboration of the displacement variation command by the control unit;

activation of corresponding displacement variation control outputs of the control unit;

wherein the valve includes a body provided with conduits for delivery of the fluid alternatively in the first semi-portion or in the second semi-portion of the cylinder, the valve comprising a spool which is movable within a seat between at least three positions of which a neutral position for blocking the fluid flow towards the cylinder, a first position for delivery of the fluid to the first semi-portion of the cylinder, a second position for delivery of the fluid to the second semi-portion of the cylinder, the spool being connected to an elastic element for return to the neutral position, the first solenoid and the second solenoid being current controlled solenoids, the system comprising a position detection device of the servo-control device for position feedback of the real position of the servo-control device, the control unit comprising a logic for current control of first output and second output with a dependency on the feedback of the position detection device, in which the method includes a control phase of the current of first output and second output depending on the feedback of the position detection device of the servo-control device for setting the real position of the servo-control device.

* * * * *